US010260841B2

(12) United States Patent
Kincel et al.

(10) Patent No.: US 10,260,841 B2
(45) Date of Patent: Apr. 16, 2019

(54) FIREARM ACCESSORY MOUNTING SYSTEM

(71) Applicant: Bravo Company MFG, Inc., Hartland, WI (US)

(72) Inventors: Eric Stephen Kincel, Las Vegas, NV (US); Jeffrey James O'Brien, Las Vegas, NV (US)

(73) Assignee: Bravo Company MFG, Inc., Hartland, WI (US)

( * ) Notice: Subject to any disclaimer, the term of this patent is extended or adjusted under 35 U.S.C. 154(b) by 0 days.

(21) Appl. No.: 15/788,720

(22) Filed: Oct. 19, 2017

(65) Prior Publication Data

US 2018/0112952 A1 Apr. 26, 2018

Related U.S. Application Data

(60) Provisional application No. 62/410,803, filed on Oct. 20, 2016.

(51) Int. Cl.

| | |
|---|---|
| ***F41G 11/00*** | (2006.01) |
| ***F41C 23/16*** | (2006.01) |
| ***F41C 23/02*** | (2006.01) |
| ***F41C 27/00*** | (2006.01) |
| *F41A 23/08* | (2006.01) |

(52) U.S. Cl.

CPC ..... *F41G 11/004* (2013.01); *F41C 23/02* (2013.01); *F41C 23/16* (2013.01); *F41C 27/00* (2013.01); *F41G 11/003* (2013.01); *F41A 23/08* (2013.01)

(58) Field of Classification Search

CPC ..... F41G 11/004; F41G 11/005; F41A 23/08; F41C 23/16; F41C 27/00; F41C 23/02

USPC ..... 42/124–127

See application file for complete search history.

(56) References Cited

U.S. PATENT DOCUMENTS

| | | | |
|---|---|---|---|
| 2,078,010 | A | 4/1937 | Meepos |
| 2,102,964 | A | 12/1937 | Mosseberg |
| 3,066,375 | A | 12/1962 | Knowles et al. |
| 3,177,587 | A | 4/1965 | Hart |
| 3,512,653 | A | 5/1970 | Erismann |
| 3,559,940 | A | 2/1971 | Kruzell |
| 3,798,818 | A | 3/1974 | Casull |
| 3,844,627 | A | 10/1974 | Gutner |
| 3,861,070 | A | 1/1975 | Wild et al. |
| 4,167,884 | A | 9/1979 | Santanna |
| 4,663,875 | A | 5/1987 | Tatro |

(Continued)

FOREIGN PATENT DOCUMENTS

| | | |
|---|---|---|
| EP | 1832835 | 9/2007 |
| WO | 2013010515 | 1/2013 |

OTHER PUBLICATIONS

Co-pending U.S. Appl. No. 15/885,071, filed Jan. 21, 2018.
Co-pending U.S. Appl. No. 15/299,391, filed Oct. 20, 2016.
Co-pending U.S. Appl. No. 29/581,693, filed Oct. 20, 2016.

*Primary Examiner* — Joshua E Freeman

(74) *Attorney, Agent, or Firm* — Michael Best & Friedrich LLP

(57) ABSTRACT

A firearm accessory mounting system includes a mounting assembly coupled to a firearm accessory, a mounting fastener, and a mounting bolt. The mounting fastener is rotatable between a locked positioned and an unlocked position. The mounting bolt is coupled to the mounting fastener for rotating the mounting fastener between the locked position and the unlocked position.

10 Claims, 22 Drawing Sheets

(56) References Cited

U.S. PATENT DOCUMENTS 4,905,396 A 3/1990 Bechtel
4,959,908 A 10/1990 Weyrauch
5,078,215 A 1/1992 Nau
5,590,484 A 1/1997 Mooney et al.
5,603,594 A 2/1997 Lincoln
5,632,108 A 5/1997 Ruger et al.
6,609,321 B2 8/2003 Faifer
6,733,221 B2 5/2004 Linger
6,836,990 B2 1/2005 Shiloni
6,874,269 B2 4/2005 Chen et al.
7,216,451 B1 5/2007 Troy
7,325,352 B2 2/2008 Matthews et al.
7,430,829 B2 10/2008 Murello
7,464,495 B2 12/2008 Cahill
D613,811 S 4/2010 Swan
7,712,242 B2 5/2010 Matthews et al.
7,716,865 B2 5/2010 Daniel et al.
7,770,317 B1 8/2010 Tankersley
7,793,452 B1 9/2010 Samson et al.
D636,453 S 4/2011 Fitzpatrick et al.
D641,450 S 7/2011 Ding
7,971,384 B2 7/2011 Lippard
8,006,430 B2 8/2011 Wang
8,051,595 B2 11/2011 Hochstrate et al.
8,141,289 B2 3/2012 Gomez et al.
8,201,353 B1 6/2012 Swan
8,245,428 B2 8/2012 Griffin
8,438,770 B2 5/2013 Troy
8,539,708 B2 9/2013 Kenney et al.
8,607,490 B1 12/2013 Zinsner
D703,286 S 4/2014 Chen et al.
8,739,448 B2 6/2014 Kimmel et al.
8,752,320 B2 6/2014 Masters
D710,964 S 8/2014 Chvala
8,819,980 B2 9/2014 Geissele
D717,907 S 11/2014 Montes
D717,908 S 11/2014 Montes
D720,421 S 12/2014 Chen
D721,407 S 1/2015 Chu
8,925,236 B1 * 1/2015 Mayberry ..... F41G 11/005 42/124
D722,356 S 2/2015 Keller et al.
D725,723 S 3/2015 Eddie
9,103,625 B2 8/2015 Masters
9,157,697 B2 10/2015 Leclair
D744,054 S 11/2015 Peterson et al.
D746,399 S 12/2015 Folkestad, II et al.
D746,936 S 1/2016 Huang
9,239,209 B2 * 1/2016 Mayberry ..... F41G 11/005
9,239,210 B2 * 1/2016 Mayberry ..... F41C 23/16
9,243,866 B2 1/2016 Roberts et al.
D749,181 S 2/2016 Hu
D751,661 S 3/2016 Gibbens et al.
9,297,599 B2 3/2016 Underwood et al.
9,303,949 B1 4/2016 Oglesby
D755,338 S 5/2016 Stank
D757,201 S 5/2016 Meier
D757,204 S 5/2016 Chow et al.
D757,878 S 5/2016 Barfoot et al.
9,377,274 B2 * 6/2016 Kincel ..... F41C 23/16
9,389,043 B1 7/2016 Zhang
9,429,388 B2 8/2016 Mayberry et al.
D768,800 S 10/2016 Willits
9,464,865 B2 10/2016 Shea et al.
9,476,672 B2 10/2016 Wells et al.
D771,216 S 11/2016 Dubois
9,482,487 B2 11/2016 Roberts et al.
9,523,554 B2 * 12/2016 Mayberry ..... F41C 23/16
D779,013 S 2/2017 Cheng et al.
D779,014 S 2/2017 Cheng et al.
9,581,412 B2 * 2/2017 Cheng ..... F41G 11/005
9,599,439 B1 3/2017 Sylvester
D783,760 S 4/2017 Pavlick
D783,761 S 4/2017 Pavlick
D785,743 S 5/2017 Pavlick
9,696,112 B2 * 7/2017 Gottzmann ..... F41C 23/16
9,709,358 B2 * 7/2017 Kincel ..... F41C 27/00
D795,986 S 8/2017 Frederickson et al.
9,921,029 B2 3/2018 Roberts et al.
9,964,380 B1 * 5/2018 Oglesby ..... F41C 23/16
9,976,832 B2 5/2018 Mayberry et al.
2001/0045046 A1 11/2001 Otteman
2004/0009034 A1 1/2004 Miller
2005/0268512 A1 12/2005 Battaglia
2006/0191183 A1 8/2006 Griffin
2008/0092422 A1 4/2008 Daniel et al.
2008/0301994 A1 12/2008 Langevin et al.
2009/0000175 A1 1/2009 Potterfield et al.
2009/0100734 A1 4/2009 Swan et al.
2009/0178325 A1 7/2009 Veilleux
2010/0122485 A1 5/2010 Kincel
2010/0242332 A1 9/2010 Teetzel et al.
2010/0319231 A1 12/2010 Stone et al.
2011/0032694 A1 2/2011 Swan et al.
2011/0126443 A1 6/2011 Sirois
2011/0192066 A1 8/2011 Kimmel et al.
2012/0042557 A1 2/2012 Gomez et al.
2012/0097807 A1 * 4/2012 Rees ..... F24J 2/5203 248/121
2012/0124880 A1 5/2012 Leclair
2012/0167434 A1 7/2012 Masters
2012/0180359 A1 7/2012 Fitzpatrick et al.
2012/0186123 A1 7/2012 Troy et al.
2012/0311908 A1 12/2012 Kenney et al.
2013/0031820 A1 2/2013 Deros
2013/0036646 A1 2/2013 Rubac et al.
2013/0104441 A1 5/2013 Kincel
2013/0133238 A1 5/2013 Quetschke
2013/0276341 A1 10/2013 Wells et al.
2013/0318848 A1 12/2013 Kincel
2014/0000142 A1 1/2014 Patel
2014/0026459 A1 1/2014 Yan et al.
2014/0041273 A1 2/2014 Masters
2014/0059908 A1 3/2014 Dextraze et al.
2014/0115938 A1 5/2014 Jarboe
2014/0115939 A1 5/2014 Troy et al.
2014/0115940 A1 5/2014 Bonelli et al.
2014/0130390 A1 5/2014 Geissele
2014/0204566 A1 7/2014 Kay
2014/0373419 A1 12/2014 Leclair
2015/0000171 A1 1/2015 Roberts
2015/0198408 A1 * 7/2015 Kincel ..... F41C 23/16 42/72
2015/0198412 A1 7/2015 Roberts et al.
2015/0219422 A1 * 8/2015 Kincel ..... F41G 11/003 29/525.11
2015/0267993 A1 9/2015 Cheng et al.
2015/0285583 A1 * 10/2015 Mayberry ..... F41G 11/005 42/71.01
2015/0285584 A1 * 10/2015 Mayberry ..... F41C 23/16 42/71.01
2015/0285585 A1 * 10/2015 Hewes ..... F41C 23/16 42/71.01
2015/0316347 A1 11/2015 Shea et al.
2015/0369555 A1 12/2015 Daniel et al.
2015/0369558 A1 12/2015 Gottzmann
2016/0010946 A1 1/2016 Gibbons et al.
2016/0025120 A1 1/2016 Swan et al.
2016/0069638 A1 3/2016 Roberts et al.
2016/0091277 A1 * 3/2016 Mayberry ..... F41C 23/16 42/71.01
2016/0169617 A1 6/2016 Daley, Jr.
2016/0187100 A1 * 6/2016 Mayberry ..... F41C 23/16 42/90
2016/0349011 A1 12/2016 Jen
2017/0016695 A1 1/2017 Willits
2017/0067718 A1 * 3/2017 Mayberry ..... F41C 23/16
2017/0082395 A1 3/2017 Roberts et al.
2017/0205183 A1 * 7/2017 Ding ..... F41A 35/02
2017/0261276 A1 9/2017 Morris
2017/0307328 A1 * 10/2017 Shelton ..... F41C 27/00
2018/0202761 A1 7/2018 Roberts et al.

* cited by examiner

FIREARM ACCESSORY MOUNTING SYSTEM

BACKGROUND

The subject invention generally concerns firearm equipment. More particularly, e present invention relates to an accessory mounting system for a firearm.

Firearm users have long desired ways to flexibly enhance the functionality of stock firearms. As a result, modern day firearms like the AR-15 and M-16 often feature an accessory rail capable of receiving one or more accessories such as a flashlight or sling mount. In most firearm designs, the accessory rail is either coupled to or permanently integrated with the barrel, upper receiver, handguard, or forestock of the firearm. The most well-known accessory rail is the Military Standard 1913 Picatinny Arsenal rail, commonly referred to simply as a "Picatinny rail." Although the Picatinny rail is still commonly used today, firearm designers have also begun producing other types of rails, including modular external accessory rails. One such modular external accessory rail is the KeyMod™ rail designed by Eric Kincel and VLTOR Weapon Systems of Tucson, Ariz.

To date, firearm users have typically coupled firearm accessories to accessory rails by using a traditional "screw and nut" method. When using the traditional screw and nut method, a user must align threaded holes in the accessory with a corresponding hole, groove, slot, or other opening in the accessory rail. There are several ways in which the accessory may be installed before it is secured in place by the screw and nut. After having aligned the accessory with the rail, the user must place a screw in each threaded hole and tighten the screw until it compresses the accessory against the rail. The tension applied by the compressed screw and nut holds the accessory in place against the accessory rail. One example of a firearm accessory that requires use of the screw and nut method is the QD Direct Attach Swivel Mount sold by Noveske Rifleworks LLC of Grants Pass, Oreg. Another example is the KeyMod QD RL Sling Mount sold by Impact Weapons Components, LLC of Timnath, Colo.

Other methods of coupling firearm accessories to accessory rails utilize slide-on mechanisms. In many cases, the top of the accessory contains a groove into which the bottom edge of a correspondingly shaped accessory rail slides. When using the slide-on method, a user must slide the accessory onto the rail. After doing so, the user must effectively "lock" the accessory in place to prevent further sliding along the rail. In many cases, the user must do so by tightening a "screw-core" locking mechanism that runs through the accessory. When tightened sufficiently, the screw-core protrudes from the accessory into a corresponding hole in the accessory rail. Having been fitted within the hole in the accessory rail, the protruding portion of the screw-core then impedes any further movement of the accessory along the rail.

A similar method relies on a rotatable accessory body. When using the rotatable body method, rather than having to slide the accessory into a groove in the accessory rail, the user must rotate the body of the accessory onto the edge of the rail before locking it into place using a screw-core mechanism. Another method features a thumb knob in place of the screw discussed above, while yet another requires the use of moveable clamps or throw-level tensioning devices to hold the accessory in place against the accessory rail.

Although adequate in some scenarios, each of the above methods suffers from one or more limitations. Some are less than optimal because they require the use of coupling mechanisms that feature numerous moving parts. When coupling mechanisms feature numerous moving parts, they are more expensive to manufacture and ultimately to purchase as a consumer. The use of many moving parts also increases the likelihood of mechanical failure. Other methods are sub-optimal because they rely on coupling devices that, after having been installed, protrude from the firearm and risk getting snagged on clothing, equipment, or other nearby objects. Other methods are limited in their usefulness simply because they are inconvenient, is time-consuming and not user-friendly, and/or difficult for users to perform. This is especially detrimental under conditions where ease of use and speed are essential, such as when the user is actively engaged in combat, self-defense, or law enforcement activities. Given such limitations, there is a need in the firearm community for improved methods and systems of coupling various types of firearm accessories to a firearm.

The present invention is aimed at one or more of the problems identified above.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION

The invention overcomes some of the disadvantages of known betting systems by providing, among other things, systems and methods for coupling various types of firearm accessories to a firearm. Firearm accessories coupled to firearms using the methods and systems disclosed herein may enjoy substantially lower profiles than many accessories currently on the market. In various embodiments, because the head of the coupling member is disposed inside rather than outside the accessory rail, less material is exposed and positioned to cut the user or become snagged on equipment or environmental objects. These types of "high-speed low-drag" features are particularly sought after for military and law enforcement applications. The low profile may also result in a substantially smoother and more appealing aesthetic finish.

Although certain embodiments of those methods and systems are discussed herein, it should be understood that they are exemplary only and in no way limit the scope of the present disclosure. Persons of ordinary skill in the art will readily recognize that the present disclosure suggests many other possible embodiments in addition to those expressly described herein. For instance, it should be readily apparent to persons of ordinary skill in the art that the methods and systems described herein are suitable for coupling many types of accessories, such as hand grips, flashlights, vertical grips, supplemental rail panels, or any number of other firearm accessories. It should also be readily apparent to persons of ordinary skill in the art that the methods and system described herein are equally applicable to other types of accessory rails, such as the standard Picatinny rail. In other words, it is contemplated that the system and methods disclosed herein may be used to attach any firearm accessory to any type of accessory rail.

Figure 1:
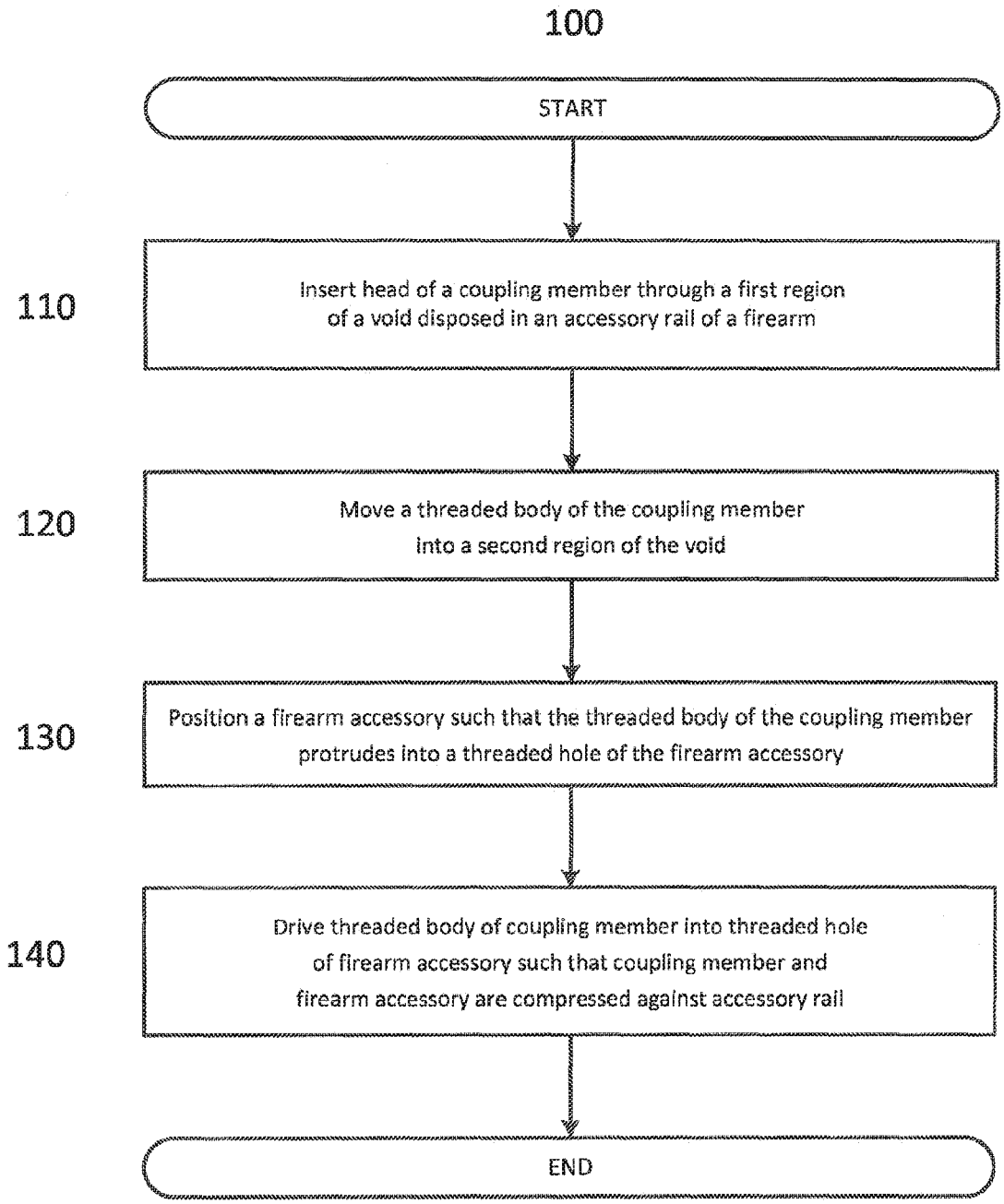
FIG. 1 is a flow diagram illustrating an exemplary method for coupling various types of firearm accessories to a firearm.

FIG. 1 is a flow diagram illustrating an exemplary method for coupling various types of firearm accessories to a firearm. In an embodiment, a method 100 of coupling a firearm accessory to a firearm may inserting a head of a coupling member through a first region of a void disposed in an accessory rail of the firearm at step 110. The void may have a second region with an area less than the area of the first region. The head may have a diameter that fits through the first region of the void but not through the second region of the void. The first region and the second region may each of which may be defined by a distinctly sized hollow area. In some embodiments, the first and second regions of the accessory rail may be part of a common void. In embodiments wherein the area of the second region is less than the area of the first region, objects of a certain diameter may pass through the first region without being able to pass through the second region.

Method 100 may further include moving a threaded body of the coupling member into the second region of the void at step 120. The threaded body may have a drive region disposed at an end opposite the head. The head may not include a drive region or any interface for a screwdriver or other tool. In some embodiments, the coupling member may be an inverted screw. Method 100 may also include positioning a firearm accessory such that the threaded body of the coupling member protrudes into a threaded hole of the firearm accessory at step 130. The threaded hole may have a diameter and thread complementary to the diameter and thread of the threaded body of the coupling member.

At step 140, method 100 may further include driving the threaded body of the coupling member into the threaded hole of the firearm accessory such that the coupling member and firearm accessory are compressed against the accessory rail.

The accessory rail may be a standard or modified Picatinny rail, a modular external accessory rail that mates with firearm accessories and may have a keyhole configuration (e.g., a Key Mod™ rail), or any other suitable type of accessory rail. For illustrative purposes, the figures disclosed herein depict embodiments in a context wherein the firearm accessory is a sling mount. It should be clearly understood, however, that the methods and systems may also be used with any other suitable firearm accessory, such as a flashlight, a scope, a laser sight, a grip, a supplemental Picatinny rail panel, or a supplemental modular external accessory rail panel that mates with firearm accessories (e.g., a supplemental Key Mod™ rail panel).

In some embodiments, driving the coupling member into the firearm accessory such that the coupling member and firearm accessory are compressed against the accessory rail may not require using a nut complementary to the coupling member. For instance, in one embodiment, the coupling member may be an inverted screw or similar fastening device. The inverted screw may include a head and a threaded body. Unlike a conventional screw, which features a drive region at the head of the screw, the inverted screw may feature a drive region disposed in the threaded body at the end opposite the head. The drive region may be a female depression or hole that mates with a correspondingly shaped male member, such as the head of a hex or "Allen" wrench, a six lobe drive, a screwdriver, or other suitable driving tool.

In some embodiments, the complementary threads of the threaded body and threaded hole may be reverse threads. The threads of conventional screws are designed such that the application of a rotational force to the drive region upon the head of the screw in a clock-wise direction drives the screw away from the drive region. The same force applied to the drive region of an inverted screw featuring left-handed threads and a drive region disposed at the end of the threaded body opposite the head, however, drives the screw towards the drive region. As a result, any object (e.g., the surface of an accessory rail) positioned between the head of the screw and the drive region is forced towards the drive region. Alternatively, the threads may be right-handed.

When an accessory featuring complementary threaded holes is coupled to the threaded body of the inverted screw, the screw is driven towards the coupled accessory until the head of the screw and the accessory meet at the intervening object. Absent any further space for the head of the screw and/or accessory to travel along the length of the threaded body of the screw, driving the screw further applies an opposing force to each side of the intervening object. As a result, the accessory is effectively compressed securely against the intervening object by the inverted screw.

In some embodiments, method 100 may include the use of a firearm accessory that itself couples with a further component. For instance, the firearm accessory may include a first coupling region that mates with a second coupling region of an additional accessory component. The first coupling region may be a female depression or hole. The female depression or hole may mate with a male member of an additional accessory component, such as a sling swivel. One exemplary sling swivel is the Uncle Mike's style QDS Quick Detachable Sling Swivel by VLTOR Weapon Systems of Tucson, Ariz. The firearm accessory may also include a recoil lug.

Figure 2A:
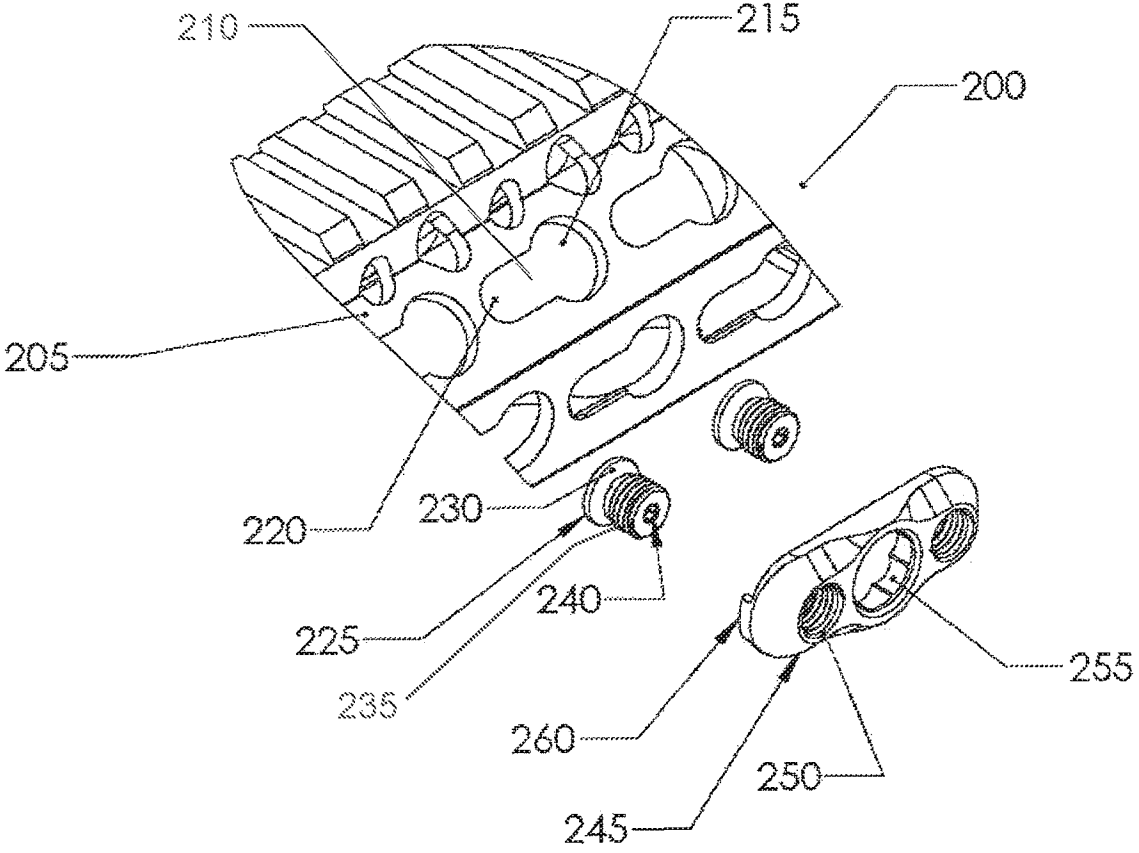
FIG. 2A is an exploded perspective view of an exemplary system for coupling various types of firearm accessories to a firearm.

FIG. 2A is an exploded perspective view of an exemplary system for coupling a firearm accessory to a firearm. In an embodiment, system 200 may include a firearm having an accessory rail 205. Formed in the accessory rail 205 is a plurality of voids 210, each void 210 including a first region 215 and a second region 220. Each first and second region 215, 220 is defined by a distinctly sized hollow area. In some embodiments, first region 215 and second region 220 may be part of a common void 210. The area of second region 220 may be less than the area of first region 215. As a result, objects of a certain diameter may pass through first region 215 without being able to pass through second region 220. Using a firearm with an accessory rail 205 that has a plurality of voids 210 may be particularly useful when the user desires to couple the firearm with certain firearm accessories that feature multiple threaded holes (discussed further below). For illustrative purposes, the figures disclosed herein depict embodiments wherein the accessory rail is a KeyMod™ rail. Persons of ordinary skill in the art will readily recognize, however, that the methods and systems disclosed herein may apply to many other types of accessory rails, such as standard Picatinny rails, modified Picatinny rails, or other modular external accessory rails or rails with keyhole configurations apart from the KeyMod™ rail that receive firearm accessories.

System 200 may further include a coupling member 225. Coupling member 225 may include a head 230 attached to a threaded body 235. Head 230 may or may not include a drive region or other interface for a screwdriver or other tool. As will be discussed in more detail below, coupling member 225 has a drive region 240 at the distal end of the threaded body 235 rather than at the head 230 as would be the case in a traditional or conventional screw. As shown in the embodiment illustrated in FIG. 2A, head 230 may have a diameter or major dimension that fits through first region 215 of void 210 but not through second region 220 of void 210. Head 230 may be a flat disc or sheet, a beveled or tapered region, or any other suitable geometric structure.

Threaded body 235 may include the above-noted drive region 240 disposed at an end opposite the head 230 (i.e., a the distal end of the threaded body 235). For instance, in one embodiment, coupling member 225 may be an inverted screw or similar fastening device. Drive region 240 may include a female depression, socket, or hole that mates with a correspondingly shaped male member, such as the head of a hex or Allen wrench, six lobe drive, screwdriver, or other suitable driving tool (not shown).

Figure 2B:
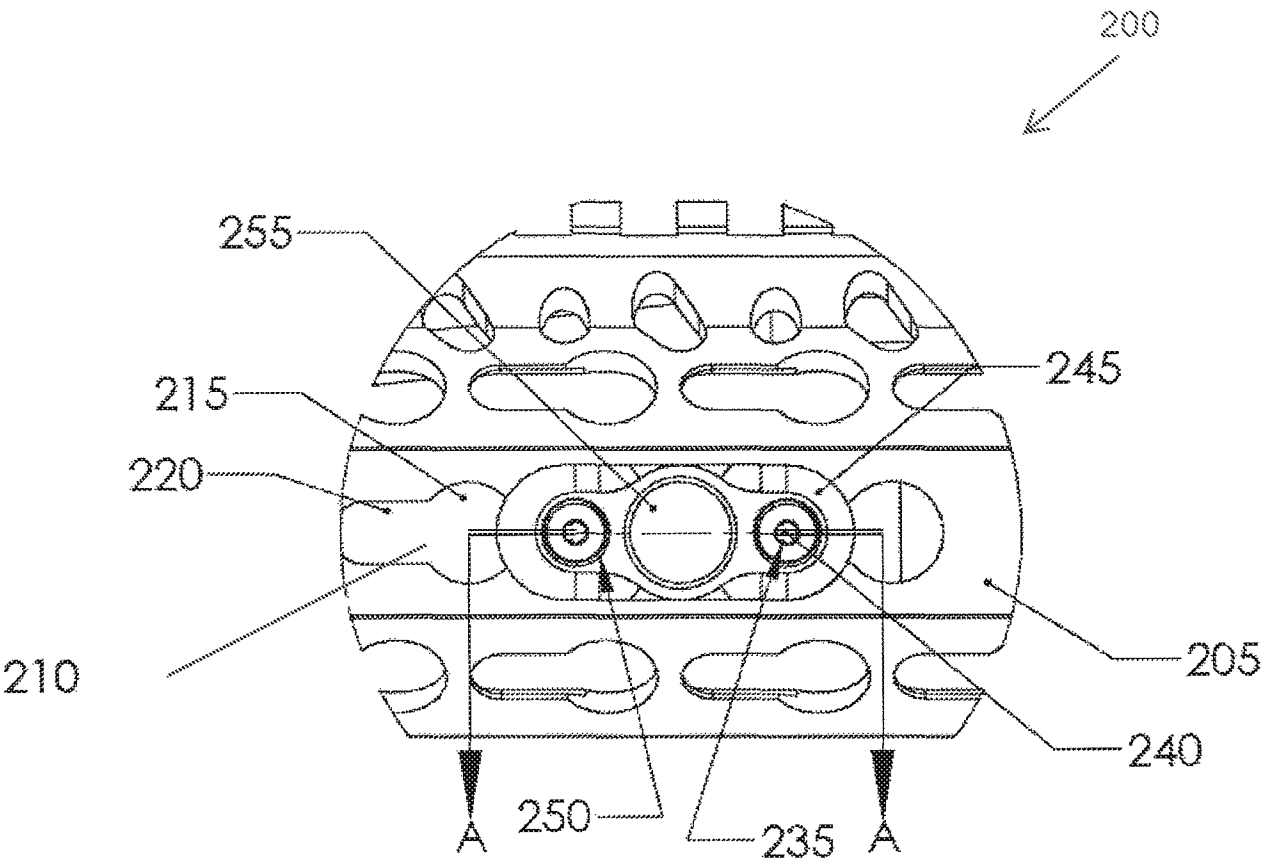
FIG. 2B is a side view of an exemplary system for coupling various types of firearm accessories to a firearm.
Figure 2C:
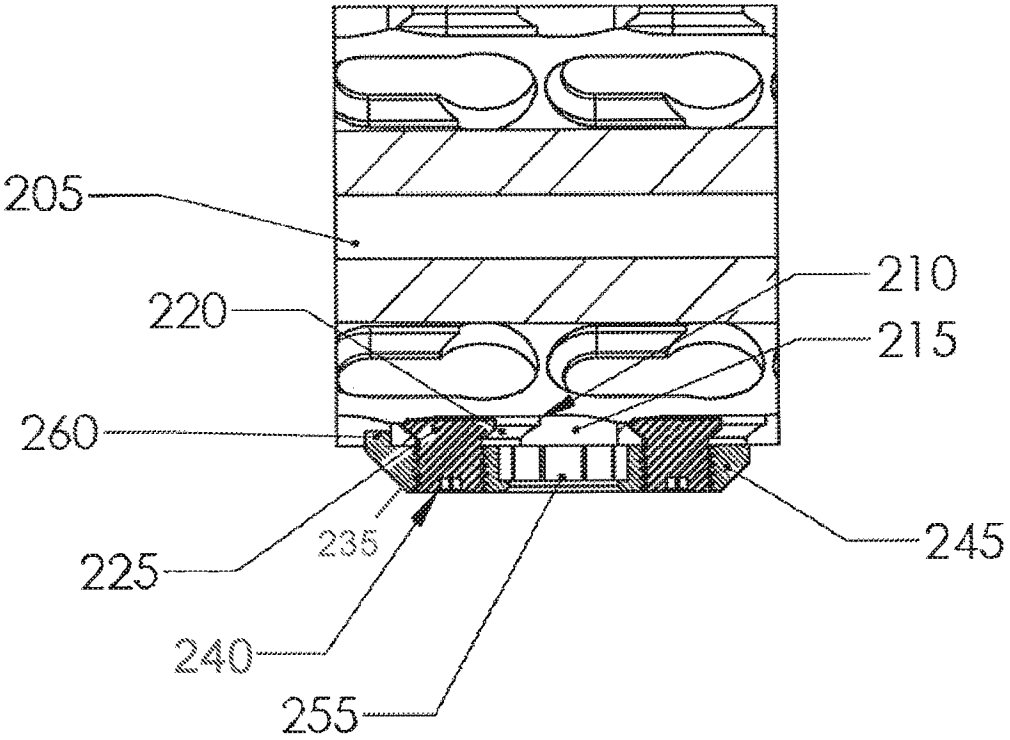
FIG. 2C is a top view of an exemplary system for coupling various types of firearm accessories to a firearm.
Figure 3:
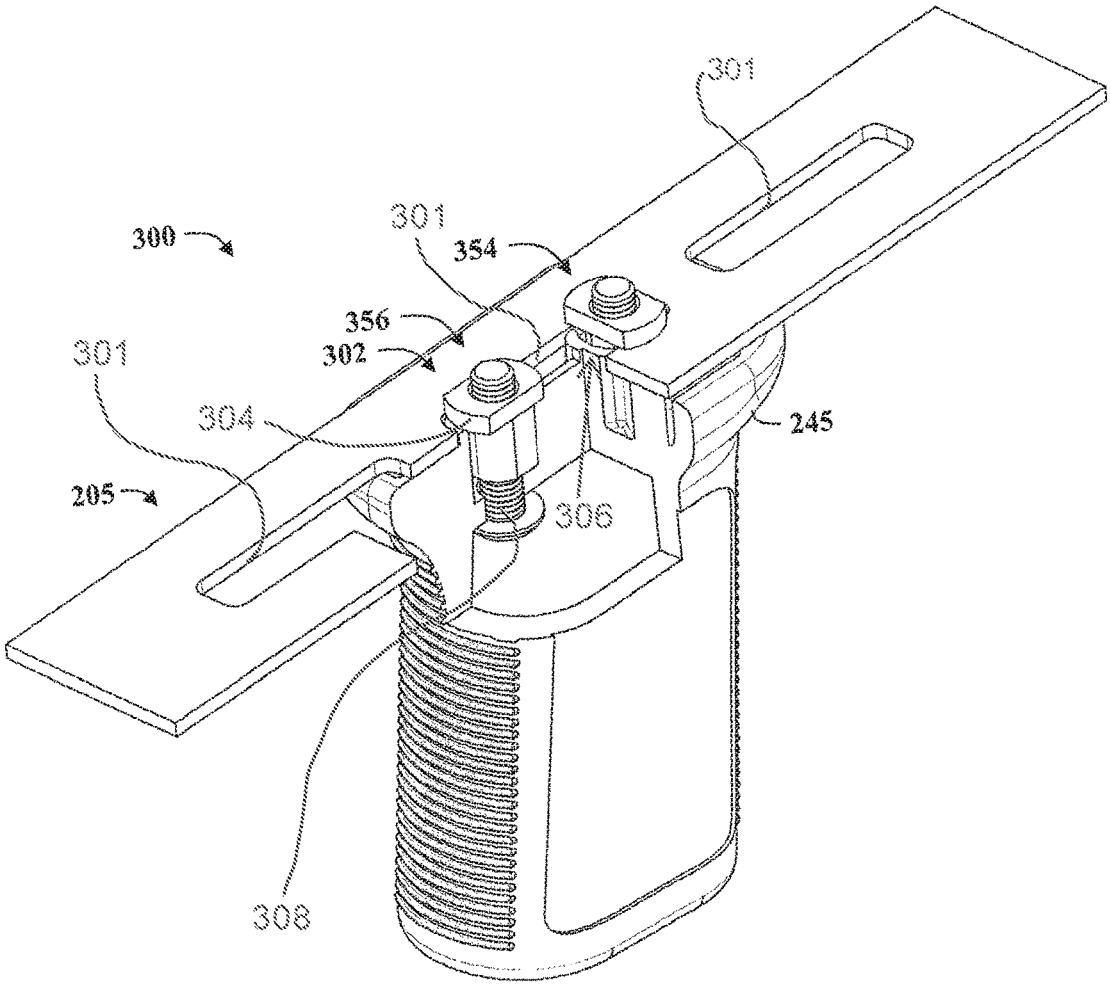
FIG. 3 is a perspective, partially cut-away view of a firearm accessory mounting system according to the present invention with a first version of a mounting fastener that includes a T-head and a relatively long diamond-shaped body.
Figure 4:
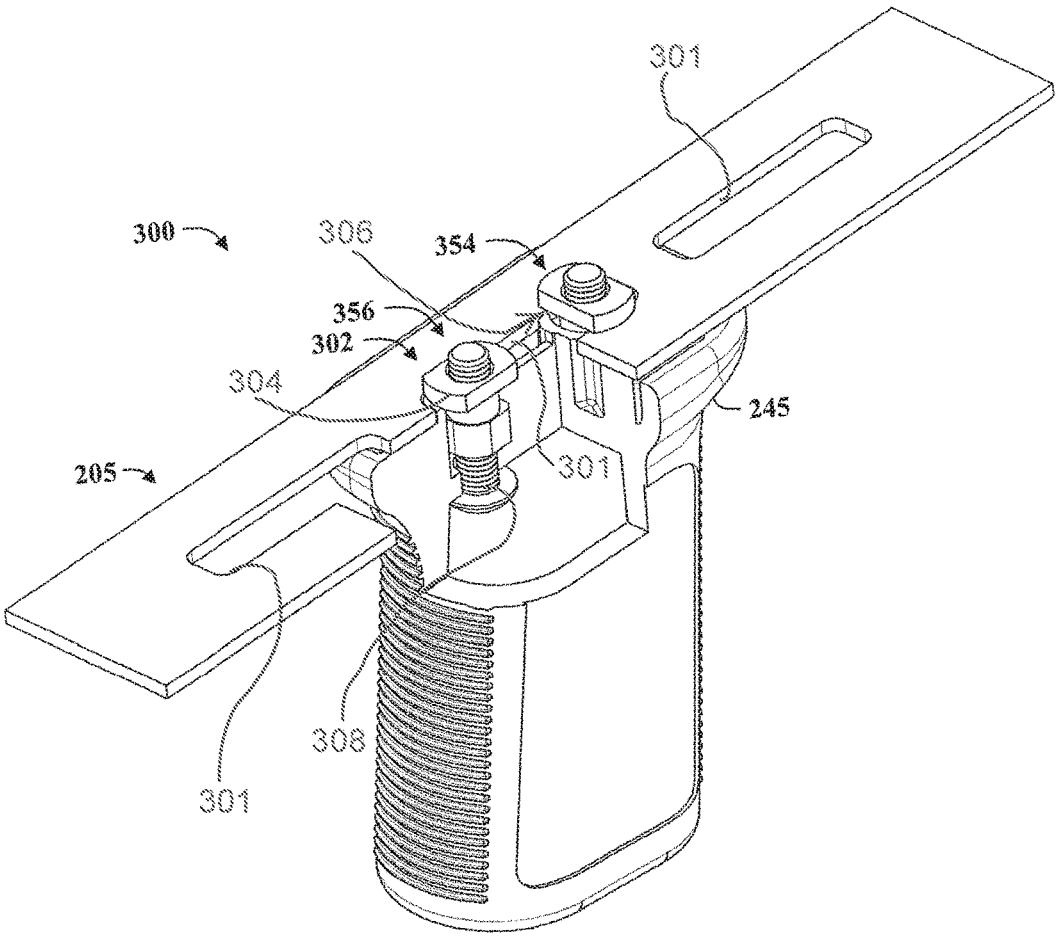
FIG. 4 is a perspective, partially cut-away view of a firearm accessory mounting system according to the present invention with a second version of a mounting fastener that includes a T-head, a cylindrical relief section, and a relatively short diamond-shaped body.
Figure 5:
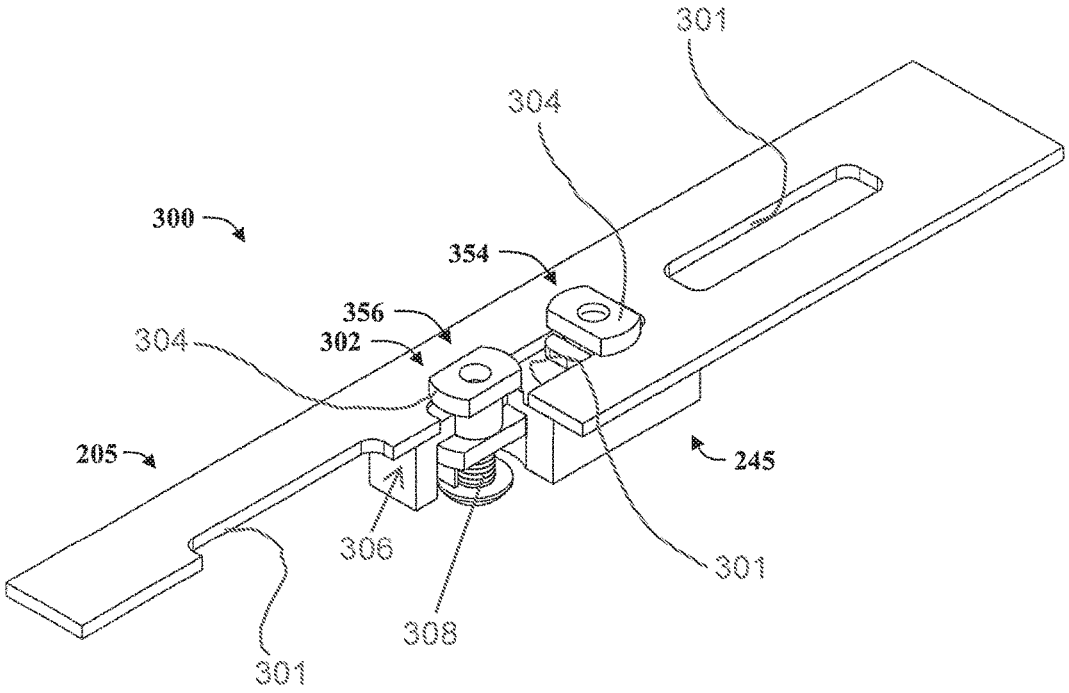
FIG. 5 is a perspective, partially cut-away view of a firearm accessory mounting system according to the present invention with a third version of a mounting fastener that includes a doubt T-nut configuration.
Figure 6:
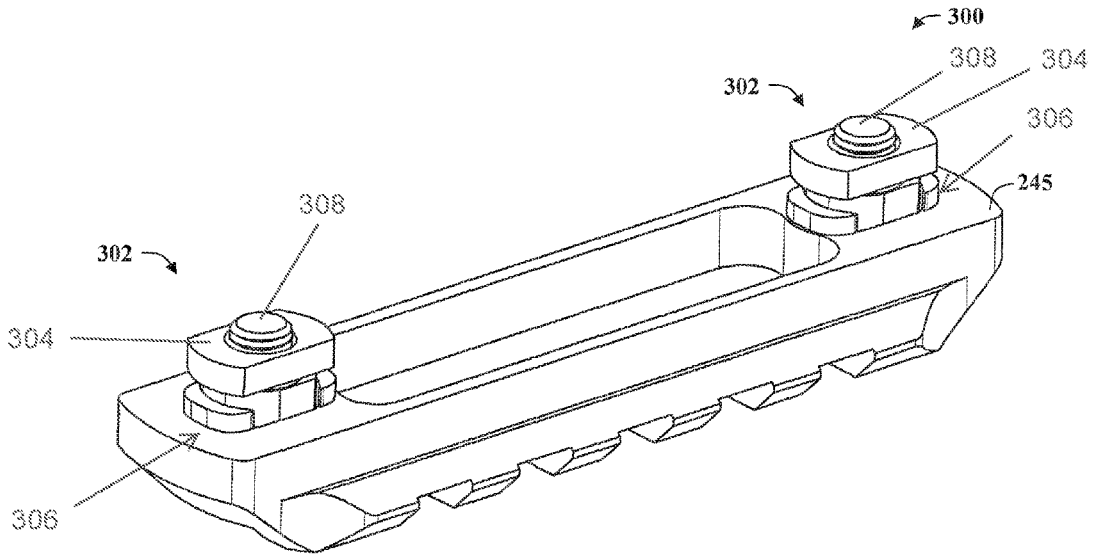
FIG. 6 is a perspective view of a firearm accessory mounting system according to the present invention with a fourth version of a mounting fastener that includes a T-head, a relatively small relief section, and a relatively short diamond-shaped body.
Figure 7:
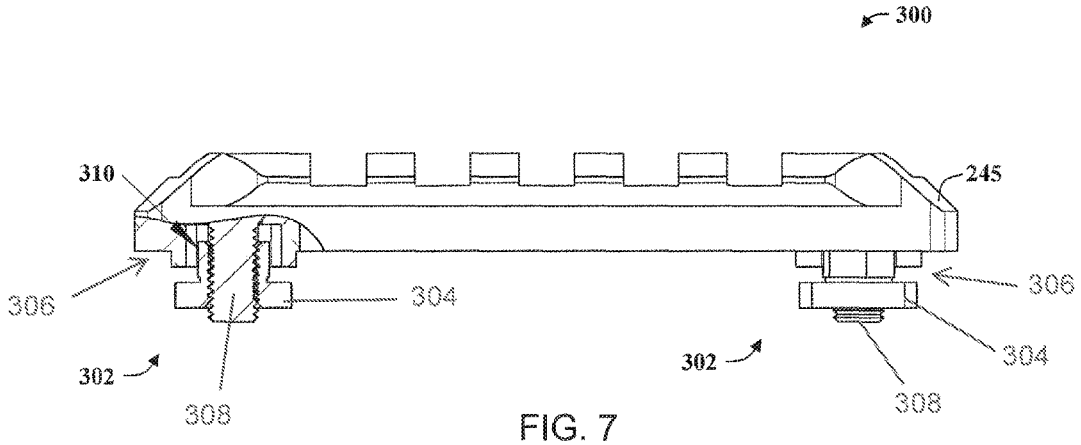
FIG. 7 is a side, partially cut-away and cross-sectional view of the firearm accessory mounting system of FIG. 6.

System 200 may further include a firearm accessory 245. Firearm accessory 245 may include a threaded hole 250. Threaded hole 250 may have a diameter and thread complementary to the diameter and thread of threaded body 235 of coupling member 225. In some embodiments, firearm accessory 245 may include a plurality of threaded holes 250. As noted above, providing a firearm with an accessory rail 205 that has multiple voids 210 may be particularly useful when firearm accessory 245 features multiple threaded holes. For illustrative purposes, FIGS. 2A, 2B, and 2C depict known mounting arrangements wherein the firearm accessory is a sling mount. It should be clearly understood, however, that the methods and systems may also be used with any other suitable firearm accessory, such as a flashlight, a scope, an optical aiming device (e.g., an infrared/laser sight), a bipod, a grip, a supplemental Picatinny rail panel, or a supplemental modular external accessory rail panel that mates with firearm accessories (e.g., a supplemental Key Mod™ rail panel).

In operation, a user may use system 100 to couple accessory 245 to accessory rail 205 of a firearm by first inserting the head of the coupling member 225 through the first region 215 of the void 210. Next, the user may move the threaded body 235 of the coupling member 225 into the second region 220 of the void 210 at step 140. With respect to the embodiment shown in FIG. 2, the user may simply slide the coupling member 225 over into the second region 220 of the void 210. The user may then position the firearm accessory 245 such that the threaded body 235 of the coupling member 225 protrudes into the threaded hole 250 of the firearm accessory 245. Once the firearm accessory 245 and coupling member 225 are aligned, the user may drive the threaded body 235 of the coupling member 225 into the threaded hole 250 of the firearm accessory such that the coupling member 225 and firearm accessory are compressed against the accessory rail.

In some embodiments, the complementary threads of threaded body 235 and threaded hole 250 may be left-handed threads. The threads of conventional screws are designed such that the application of a rotational force to the drive region upon the head of the screw in a clock-wise direction drives the screw away from the drive region. The same force applied to drive region 240 of coupling member 225 featuring left-handed threads and drive region 240 disposed at the end of threaded body 235 opposite head 230, however, drives coupling member 225 towards drive region 240. As a result, any object (e.g., a portion of accessory rail 205) positioned between head 230 of coupling member 225 and drive region 240 is forced towards drive region 240. Alternatively, the threads may be right-handed.

In such embodiments, when accessory 245 featuring complementary threaded hole 250 is coupled to threaded body 235 of coupling member 225, coupling member 225 is driven towards the coupled accessory until head 230 and accessory 245 are each left without any further room to travel along the length of threaded body 235 of coupling member 225. As a result, driving coupling member 225 any further applies an opposing force to each side of the intervening portion of accessory rail 205 such that firearm accessory 245 is effectively compressed securely against accessory rail 205.

FIG. 2B is a side view of an exemplary system for coupling various types of firearm accessories to a firearm. In some embodiments, firearm accessory 245 may itself couple with an additional component. For instance, firearm accessory 245 may include a first coupling region 255 that mates with a second coupling region of an additional accessory component (not shown). As shown in FIG. 2B, first coupling region 255 may be a female depression or hole. The female depression or hole may mate with a male member of an additional accessory component, such as a sling swivel (not shown). In other embodiments, first coupling region 255 may be a male member and the additional component may include the complementary female depression or hole. Any number of other suitable coupling mechanisms may likewise be used to couple accessory 245 to an additional component.

Where the user desires to couple to the firearm a firearm accessory 245 that itself couples to an additional component, it may be particularly beneficial for first coupling region 255 to align with a region of accessory rail 205 having sufficient space to receive the second coupling region of the additional component. For example, as illustrated in FIG. 2B, firearm accessory 245 is a sling mount. Accessory rail 205 is an exemplary form of an external modular rail system that has a keyhole configuration and is referred to above as a KeyMod™ rail. Key Mod™ rail 205 includes a plurality of spaced voids 210, each of which has a first region 215 and a second region 220 as discussed above. Voids 210 may be shaped like keyholes. Accessory 245 includes two threaded holes 250, each of which has been coupled with a corresponding threaded body 235 of a coupling member 225. Drive region 240 is visible at the end of each threaded body 235. In this particular exemplary embodiment, drive region 240 is a depression having a geometry that receives a correspondingly shaped end of a hex or Allen wrench.

Threaded holes 250 of accessory 245 are spaced such that when threaded holes 250 may each be aligned with second region 220 of a void 210. First coupling region 255 may be spaced between threaded holes 250 such that when each threaded hole 250 is aligned with a second region 220 of a void 210, first coupling region 255 is aligned with first region 215 of a void 210. For instance, as shown in FIGS. 2B and 2C, when coupled to KeyMod™ rail 205, sling mount 245 spans two voids 210. The threaded holes 250 couple with the coupling members 225 through the second regions 220 of the two voids 210, and the first coupling region 255 aligns with first region 215 of the left void 210 to form a continuous collective void through which the second coupling region of the sling swivel may couple to accessory 245. In other embodiments, the accessory 245 may span three or more voids, with the coupling region 255 aligning with a second region 220 of one of the middle voids 210.

Firearm accessory 245 may further include a recoil lug 260. Recoil lug 260 may be spaced from threaded hole 250 such that, when firearm accessory 245 is properly coupled to accessory rail 205, recoil lug 260 rests snugly against the inner edge of a void 210 of accessory rail 205. In the illustrative embodiment shown in FIG. 2B, recoil lug 260 is hidden from view beneath the far left edge of accessory 245 (against the inner edge of first region 215 of void 210). In some embodiments, recoil lug 260 may be slightly offset from the inner edge of void 210 such that a user must apply pressure to recoil lug 260 to make it "snap" into place against the inner edge. Recoil lug 260 may help to stabilize firearm accessory 245 against natural component stress caused by firearm recoil. More particularly, recoil lug 260 may help to transfer some of the stress forces caused by firearm recoil away from coupling member 225. In that way, recoil lug 260 may help to prolong the life of coupling member 225, which like all mechanical parts may be naturally inclined to weaken over time after heavy use.

FIGS. 3-28 illustrate various configurations and constructions of a firearm accessory mounting system 300 according to the present invention. The accessory mounting system 300 may be used for coupling various types of accessories 245 to a firearm accessory rail 205 that includes a plurality of elongated slots 301. In the illustrated embodiment, the mounting system 300 includes a fastener assembly 302 that includes a mounting fastener 304, a mounting assembly 306, and mounting bolt 308.

The mounting assembly 306 is coupled to a firearm accessory 245 and includes a cavity defined therein. The mounting fastener 304 extends outwardly from the mounting assembly 306 and is positioned within the cavity. The mounting fastener 304 is configure to rotate ninety degrees (90°) between a locked position (in which aligns with the slot 301 and can pass through the slot 301) and an unlocked position (in which it extends across the slot 301) to facilitate coupling the firearm accessory 245 to the firearm accessory rail 205. The mounting bolt 308 is rotatably coupled to the mounting fastener 304 for rotating the mounting fastener 304 between the locked position and the unlocked position. In one embodiment, the mounting system 300 includes a pair of fastener assemblies 302. In another embodiment, the mounting assembly 306 may include any suitable number of fastener assemblies 302 to couple the firearm accessory 245 to the firearm and/or the firearm accessory rail 205.

Figure 8:
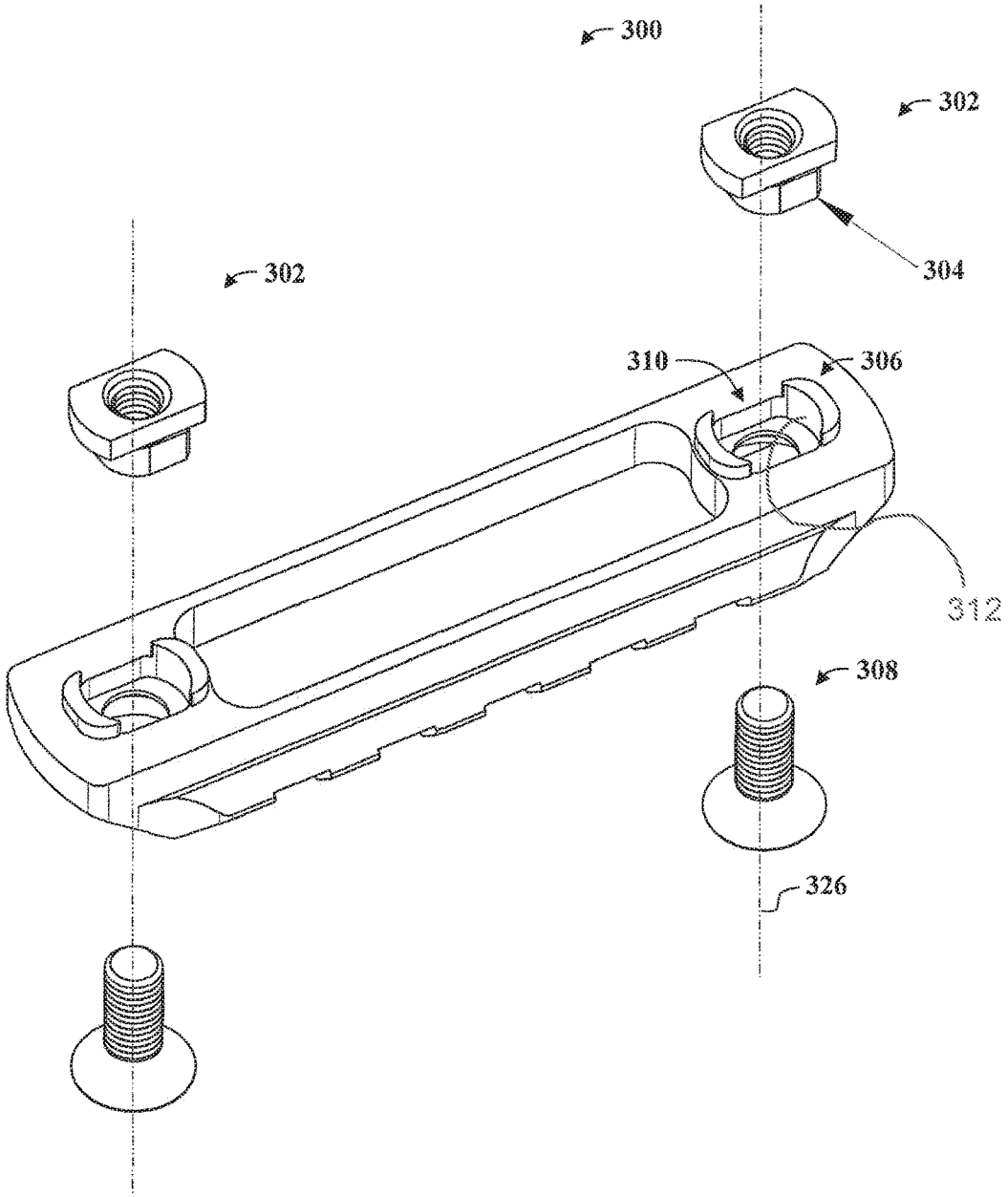
FIG. 8 is an exploded perspective view of the firearm accessory mounting system shown in FIG. 6.
Figure 9:
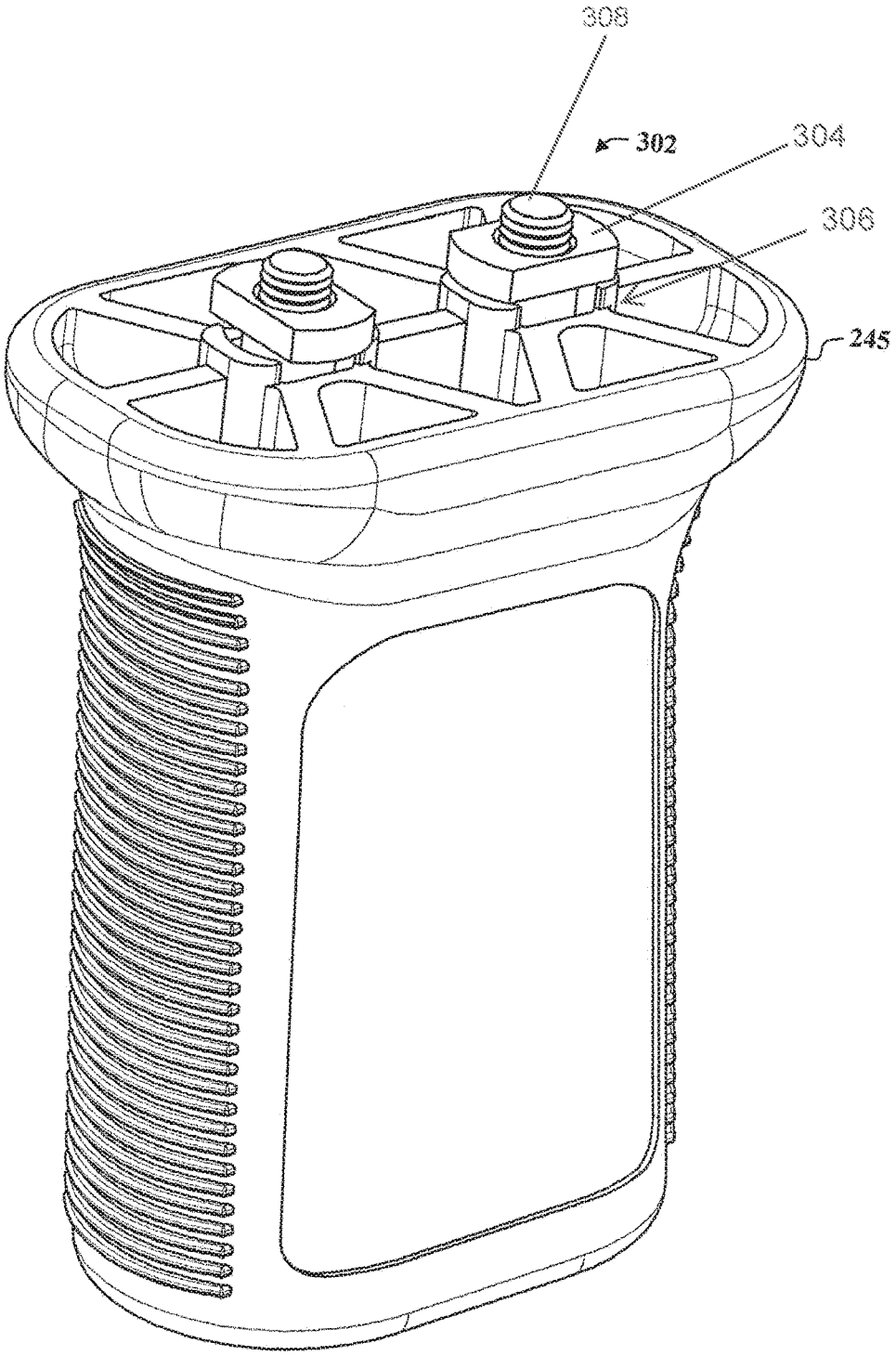
FIG. 9 is a perspective view of a firearm accessory in the form of a hand grip including the first version of a mounting fastener illustrated in FIG. 3.

With reference to FIG. 8, the mounting assembly 306 includes an inner surface that defines a mounting assembly cavity 310 that extends between a first open end and an opposite second open end, and is sized and shaped to receive at least a portion of the mounting fastener 304 therein. In one embodiment, the mounting assembly 306 is unitarily formed with the firearm accessory 245 such that the mounting assembly 306 and the firearm accessory 245 form a unitary body. In another embodiment, the mounting assembly 306 is coupled to the firearm accessory 245 with a weld, friction fit, and/or any suitable method of coupling the mounting assembly 306 to the firearm accessory 245. For example, in one embodiment, the firearm accessory 245 may include a cavity that is sized and shaped to receive the mounting assembly 306 therein.

Figure 10:
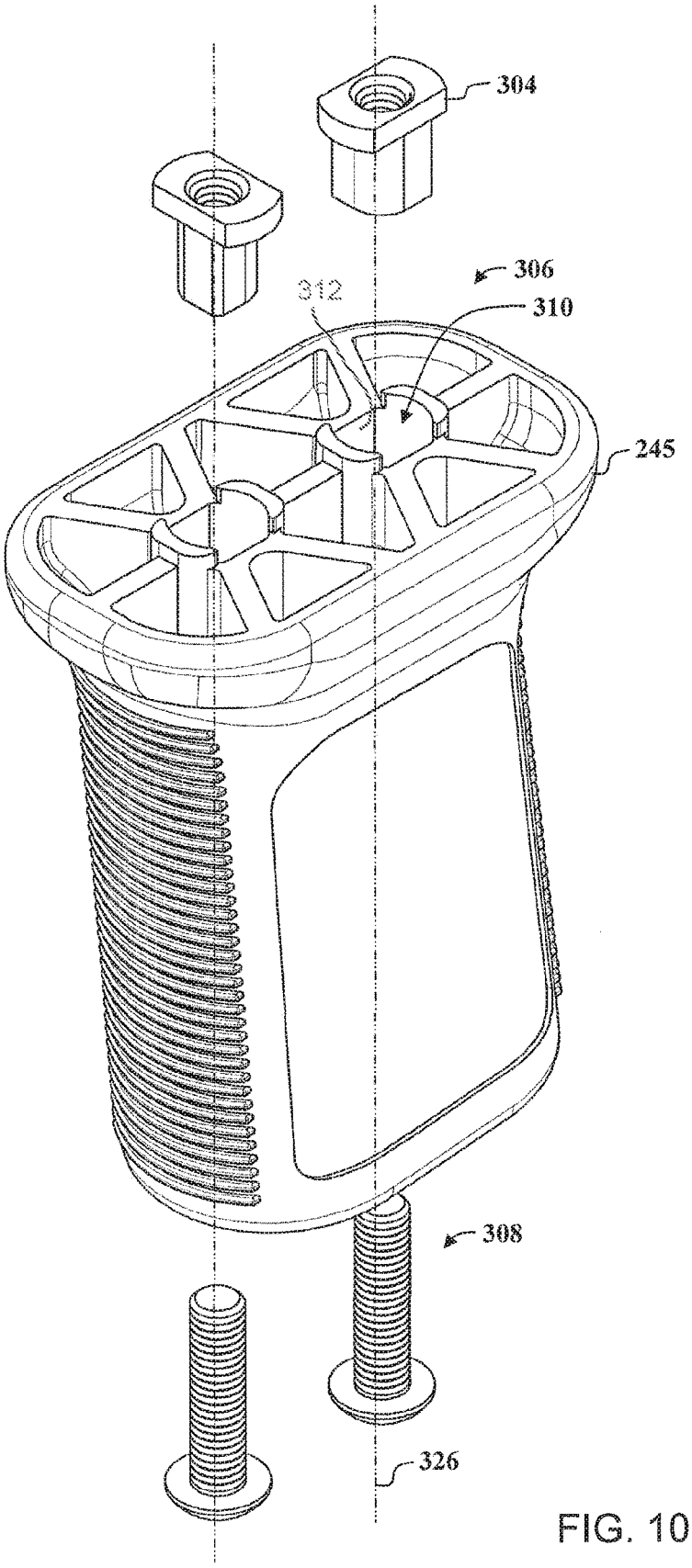
FIG. 10 is an exploded perspective view of the firearm accessory shown in FIG. 9.
Figure 11:
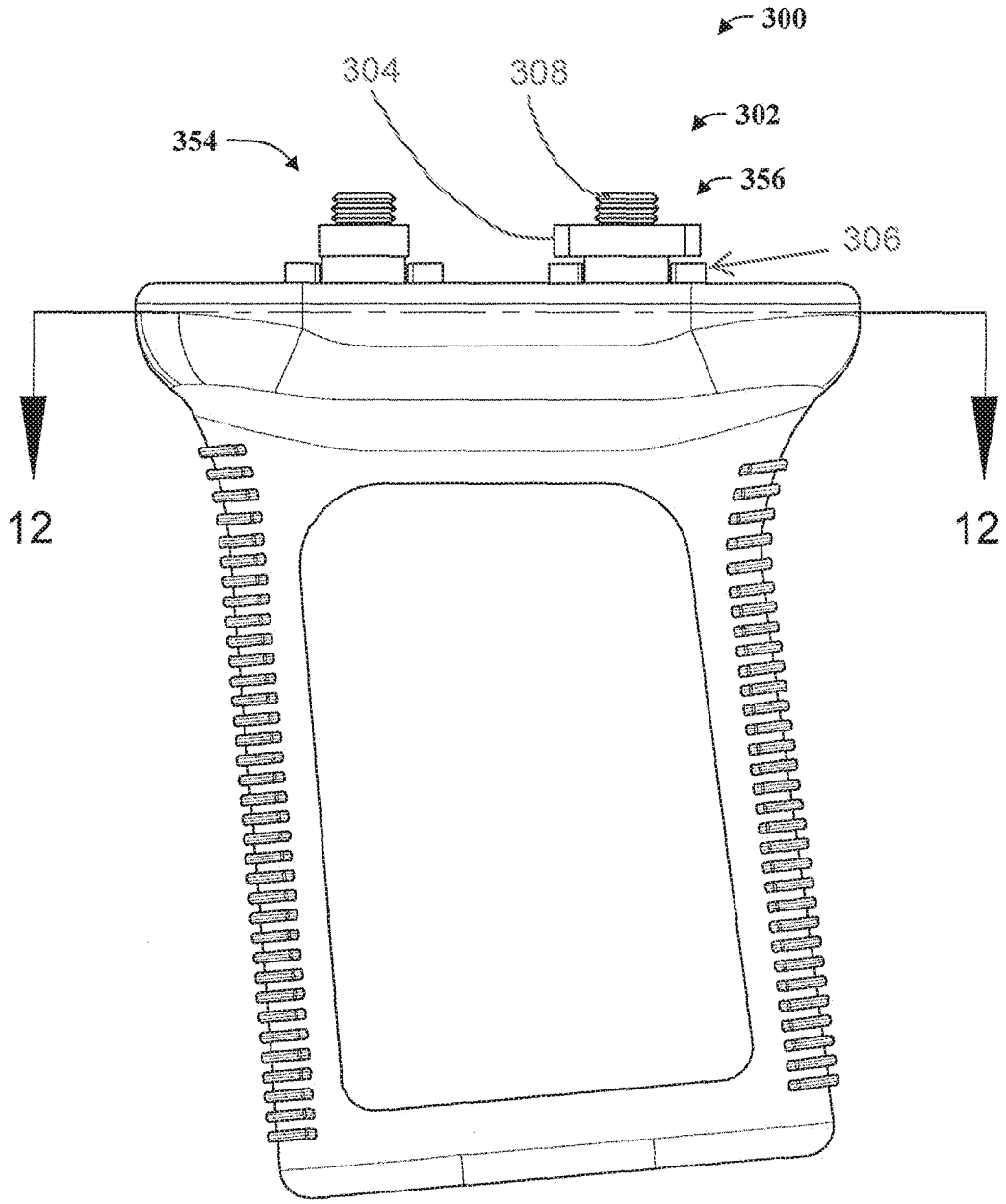
FIG. 11 is a side view of the firearm accessory shown in FIG. 9.
Figure 12:
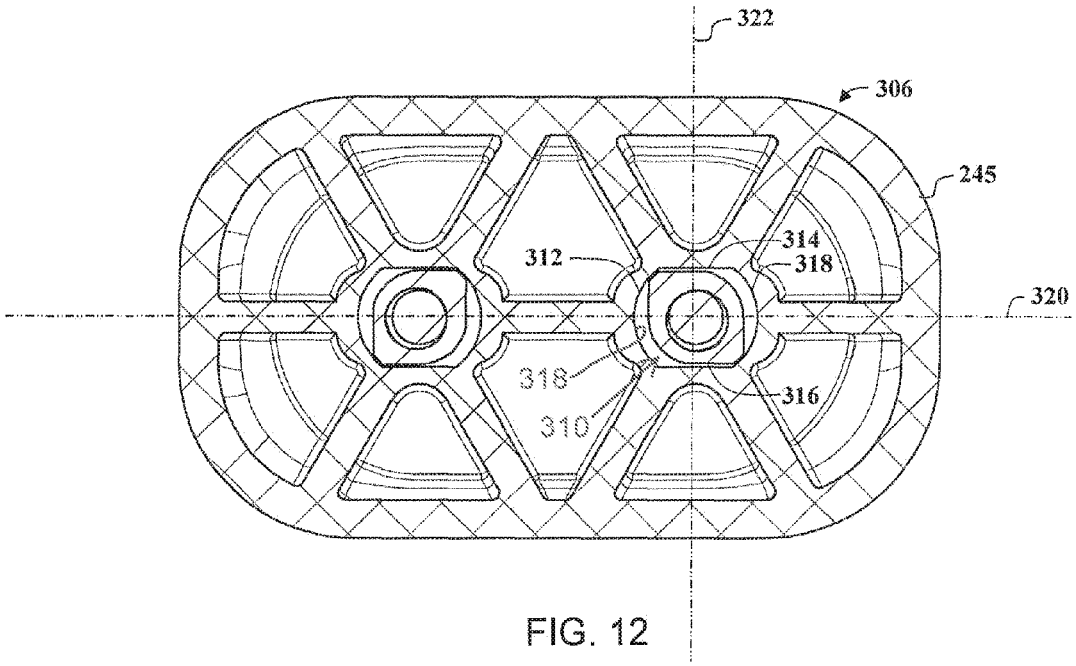
FIG. 12 is a sectional view of the firearm accessory taken along section line 12-12 in FIG. 9.
Figure 13:
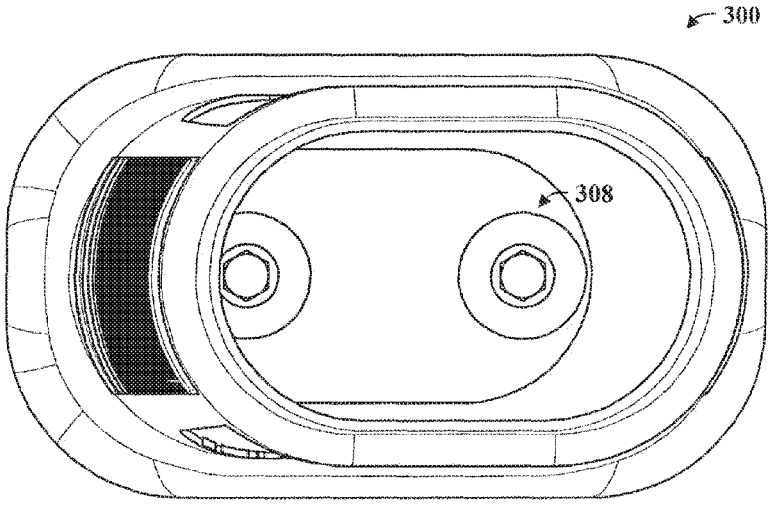
FIG. 13 is a bottom view of the firearm accessory shown in FIG. 9.

Referring now to FIGS. 8, 10, and 12 the inner surface of the mounting assembly 306 includes a plurality of interior walls 312 that define the mounting assembly cavity 310. In one embodiment, as shown in FIG. 12, the plurality of interior walls 312 includes a first sidewall 314, a second sidewall 316, and a pair of opposing endwalls 318 that extend between the first sidewall 314 and the second sidewall 316. Each of the first and second sidewalls 314, 316 includes a substantially planar surface that extends between the pair of endwalls 318 along a longitudinal axis 320 and includes a length measure along the longitudinal axis 320. Each endwall 318 includes an arcuate surface that extends between the opposing sidewalls 314, 316 along a transverse axis 322 and includes an arc length measured generally along the transverse axis 322. In one embodiment, the first and second sidewalls 314, 316 are of include the same length and are spaced a distance apart along the transverse axis 322, with the sidewalls 314, 316 substantially parallel such the mounting assembly cavity 310 has a substantially rectangular shape with accurate ends.

Figure 14:
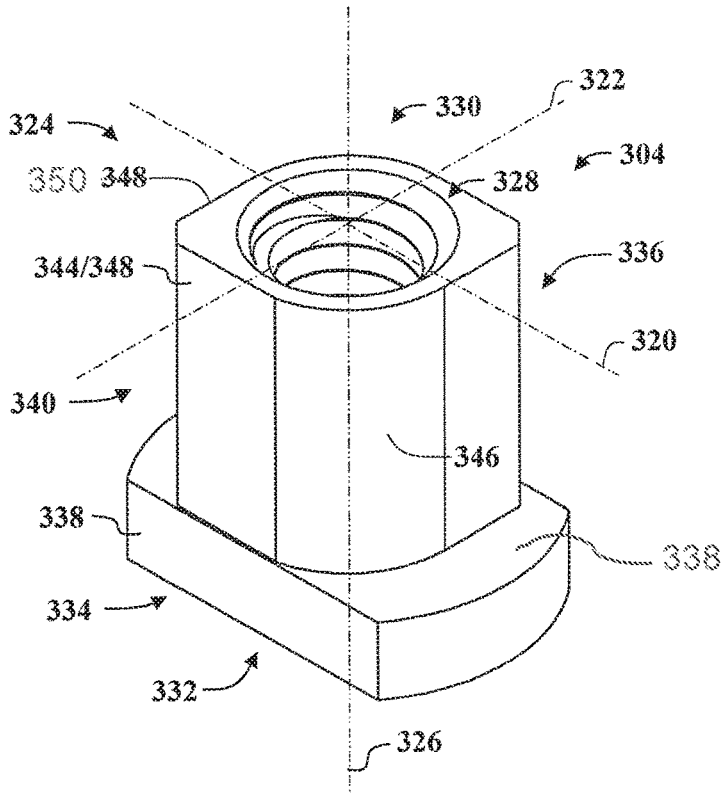
FIG. 14 is a perspective view of the first version of a mounting fastener illustrated in FIG. 3.

As illustrated in FIG. 14, the mounting fastener 304 includes a fastener body 324 that extends along a centerline axis 326. The fastener body 324 includes an inner surface that defines an interior cavity 328 that extends between a first open end 330 and a second open end 332 along the centerline axis 326. The interior cavity 328 is sized and shaped to receive the mounting bolt 308 therethrough. The inner surface includes a threaded surface that is defined along a portion of the interior cavity 328 and is configured to engage in a threaded outer surface of the mounting bolt 308.

Figure 17:
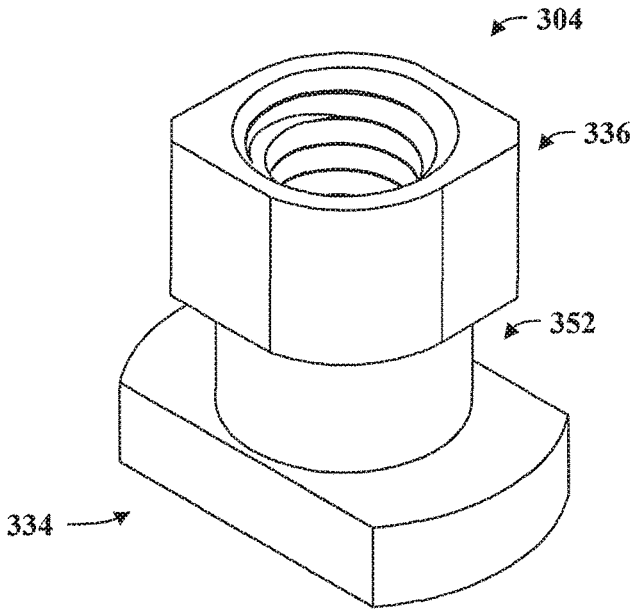
FIG. 17 is a perspective view of the second version of a mounting fastener illustrated in FIG. 4.

In the illustrated embodiment, the fastener body 324 includes a locking assembly 334 and a positioning assembly 336. The locking assembly 334 is defined at the second open end 332. The locking assembly 334 includes a pair of flanges 338 that extend radially outwardly from the centerline axis 326. Each flange 338 includes an outer surface that is sized and shaped to contact an outer surface of the firearm accessory rail 205 to facilitate coupling the firearm accessory 245 to the firearm accessory rail 205. The positioning assembly 336 extends outwardly from the locking assembly 334 along the centerline axis 326. In the illustrated embodiment, the positioning assembly 336 includes a contact portion 340 that includes an outer surface extending from the first open end 330 towards the locking assembly 334 along the centerline axis 326. The outer surface of the contact portion 340 includes a plurality of contact surfaces 344 that extend parallel to the centerline axis 326. Each contact surface 344 includes a substantially planar surface that is sized and shaped to contact an interior wall 312 of the mounting assembly 306. In one embodiment, the positioning assembly 336 may include one or more arcuate surfaces 346 that extend between contact surfaces 344. In one embodiment, the contact portion 340 may include a first contact surface 348 and a second contact surface 350. The first contact surface 348 includes a substantially planar surface that is parallel to a longitudinal axis 320. The second contact surface 350 includes a substantially planar surface that is parallel to a transverse axis 322 that is perpendicular to the longitudinal axis 320. In the illustrated embodiment, the first contact surface 348 is orientated substantially perpendicular to the second contact surface 350. In one embodiment, the positioning assembly 336 includes a pair of first contact surfaces 344 that are orientated parallel to each other and are spaced a distance apart along the transverse axis 322. In addition, the positioning assembly 336 may include a pair of second contact surfaces 350 that are orientated parallel to each other and are spaced a distance apart along the longitudinal axis 320. In one embodiment, as shown in FIG. 17, the mounting fastener 304 may include a cylindrical portion 352 that extends between the locking assembly 334 and the positioning assembly 336.

In the illustrated embodiment, the mounting fastener 304 is positioned at the first open end of the mounting assembly cavity 310 and the mounting bolt 308 is positioned at the second open end of the mounting assembly cavity 310 and is inserted through the interior cavity 328 of the fastener body 324. The mounting assembly cavity 310 is sized and shaped to receive the mounting fastener 304 therein and to allow for the partial rotation of the mounting fastener 304 with the mounting fastener 304 positioned within the mounting assembly cavity 310. For example, with reference to FIGS. 3-5 and 24, the mounting fastener 304 is configured to rotate between a locked position 354 and an unlocked position 356 when the mounting fastener 304 is positioned within the mounting assembly cavity 310. In one embodiment, the mounting fastener 304 is configured to rotate about the centerline axis 326 through a 90 degree rotational angle between the locked position 354 and the unlocked position 356.

During installation, a rotation of the mounting bolt 308 in a first rotational direction, such as a clockwise direction, causes the mounting fastener 304 to rotate from the unlocked position 356 towards the locked position 354. As the mounting fastener 304 is rotated in the first rotational direction the first contact surface 348 contacts the first sidewall 314 to position the mounting fastener 304 in the locked position 354 and to prevent additional rotation in the first direction. As the mounting bolt 308 continues rotation in the first rotational direction, the mounting bolt 308 is further inserted within the mounting fastener interior cavity 328 causing the mounting fastener 304 to move towards the mounting bolt 308, and causing the locking flange 338 to contact the firearm accessory rail 205 and the mounting bolt 308 to contact the mounting assembly 306 to couple the firearm accessory 245 to the firearm accessory rail 205 with a friction fit. In addition, a rotation of the mounting bolt 308 in an opposite second rotational direction, such as a counterclockwise direction, causes the mounting fastener 304 to rotate from the locked position 354 towards the unlocked position 356. As the mounting fastener 304 is rotated in the second rotational direction the second contact surface 350 contacts the second sidewall 316 to position the mounting fastener 304 in the unlocked position 356 and to prevent additional rotation in the second direction.

Figure 26:
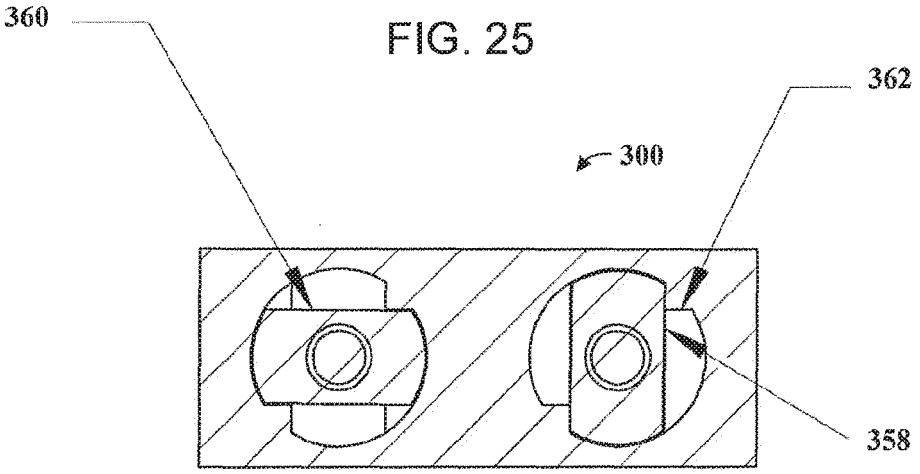
FIG. 26 is a section view of the firearm accessory mounting system shown in FIG. 25 and taken along section line 26-26.
Figure 27:
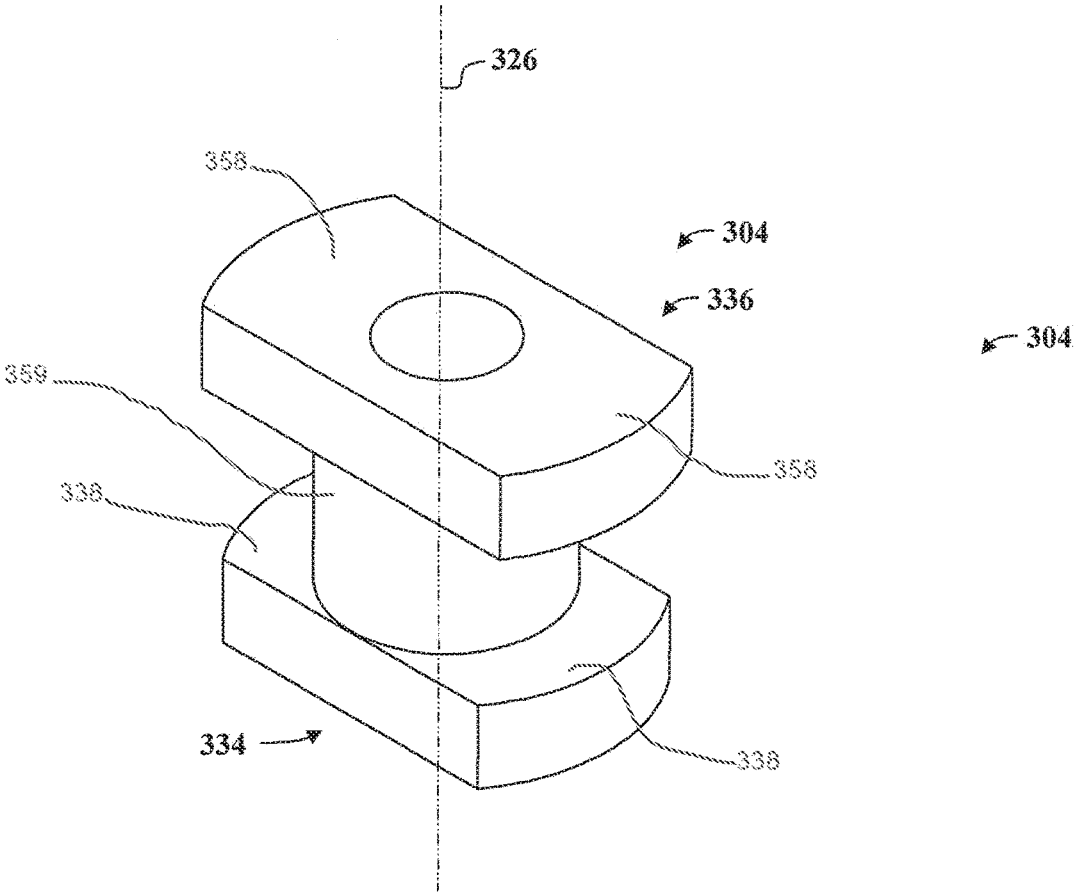
FIG. 27 is a perspective view of the third version of a mounting fastener illustrated in FIG. 5.

Referring to FIGS. 22-28, and particularly to FIG. 27, in one embodiment, the mounting fastener 304 may include a positioning assembly 336 that includes a pair of positioning flanges 358 that extend outwardly from the centerline axis 326. The mounting fastener 304 also includes a locking assembly 334 that includes a pair of locking flanges 338. A cylindrical relief section 359 connects the locking assembly 334 and positioning assembly 336 in spaced-apart relation to each other. The locking flanges 338 and positioning flanges 358 extend parallel to each other. In this regard, the mounting fastener 304 may be thought of as a double-ended T-nut or a barbell-shaped fastener having two T-nut ends. The locking flanges 338 (which extend through the slot 301 in the firearm accessory rail 205 and are turned 90° across the slot 301) are not as wide as the positioning flanges 358 in the illustrated embodiment, although in other constructions the flanges 338, 358 could be of the same size.

Figure 24:
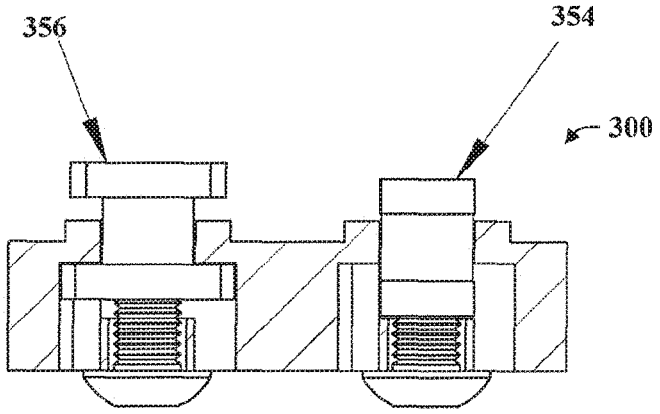
FIG. 24 is a sectional view of the firearm accessory mounting system shown in FIG. 22.
Figure 25:
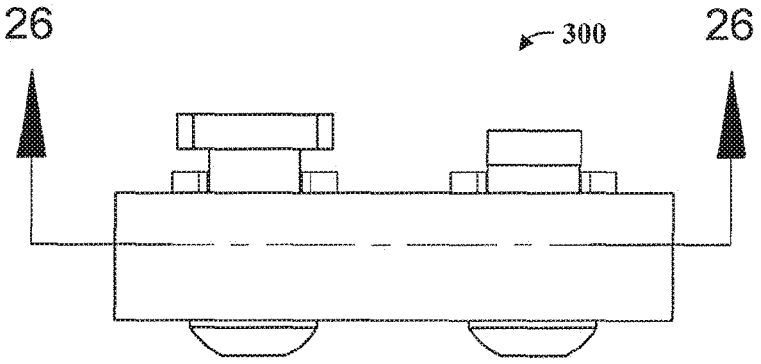
FIG. 25 is a side view of the firearm accessory mounting system shown in FIG. 22.

With reference now to FIGS. 24 and 26, the mounting assembly 306 includes a positioning slot 360 defined along the inner surface of the mounting assembly cavity 310. The positioning slot 360 is wide enough to receive the positioning assembly 336 therein when inserted from the top of the mounting assembly 306 with the positioning flanges 358 in the locked position 354. The positioning slot 360 extends under the surface of the mounting assembly 306, such that when the positioning flanges 358 are turned 90° the unlocked position 356, the positioning flanges 358 are captured within the mounting assembly 306.

The positioning slot 360 includes a pair of shoulders 362 that extend outwardly from a slot inner surface and are sized and shaped to contact the positioning flanges 358 to facilitate positioning the mounting fastener 304 at the unlocked position 356 and the locked position 354. For example, as the mounting fastener 304 is rotated in the first rotational direction, the first contact surface 348 contacts a first shoulder of the pair of shoulders 362 to position the mounting fastener 304 in the locked position 354 and to prevent additional rotation in the first direction. As the mounting fastener 304 is rotated in the second rotational direction, the second contact surface 350 contacts a second shoulder to prevent additional rotation in the second direction.

The mounting assembly 360 is therefore assembled and installed on a firearm accessory rail 205 by first installing the mounting fasteners 304 into the positioning slots 360 in the locked position 354. Then the mounting fasteners 304 are turned 90° to the unlocked position 356 in which the mounting fasteners 304 are captured in the mounting assembly 360. With the mounting fasteners 304 in the unlocked position 356, they can be passed through the slots 301 in the accessory rail 205. A mounting bolt 308 can then be threaded into the threaded interior cavity 328 in each of the mounting fasteners 304 (or the mounting bolts 308 could have been threaded into the cavities 328 prior to insertion through the slots 301). The mounting bolts 308 are turned, which initially causes the mounting fasteners 304 to rotate 90° into the locked position 354 across the slots 301. Further rotation of the bolts 308 sandwiches the mounting assembly 360 and positioning assembly 336 between the rail 205 and the heads of the mounting bolts 308.

Figure 15:
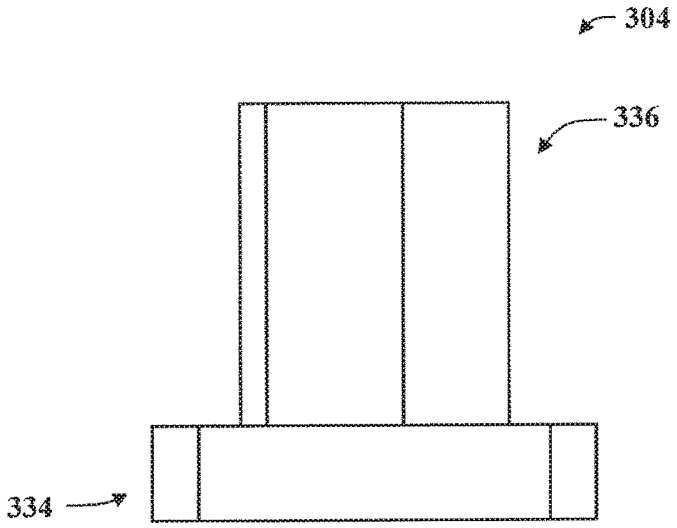
FIG. 15 is a side view of the first version of a mounting fastener illustrated in FIG. 3.
Figure 16:
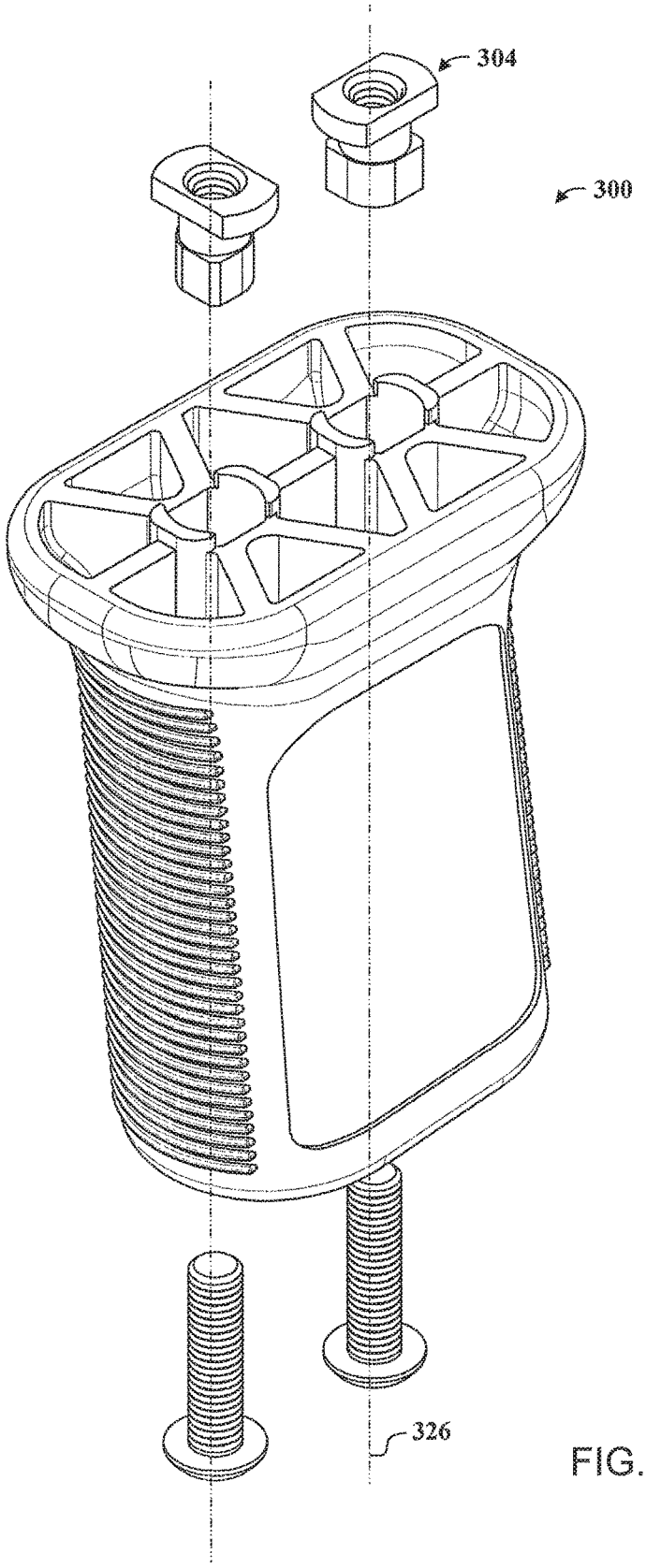
FIG. 16 is a perspective exploded view of a firearm accessory in the form of a hand grip including the second version of a mounting fastener illustrated in FIG. 4.

Referring to FIGS. 14-15, in one embodiment, the mounting fastener 304 includes a semi-diamond shape protrusion on the nut is to allow ex-amount of rotation (90 degrees) in the mounting slot width, making sure the nut is rotated to a fixed position, for the nut's T-head to be locked in the position. Without the diamond stock to stop rotation, the standard nut would keep rotating and never be allowed to tighten down. The mounting fastener 304 would reduce the chance for the nut to rotate fully with in the mounting slot. This is done by making the diamond protrusion longer, making it long enough to interface to a mating slot on the accessory itself. The mounting fastener 304 allows only 90 degree rotation, and provides extra security from the nut over rotating in the slot. The nut interfaces with the rail slot and the Accessory slot, which should eliminate any unwanted rotation.

Figure 18:
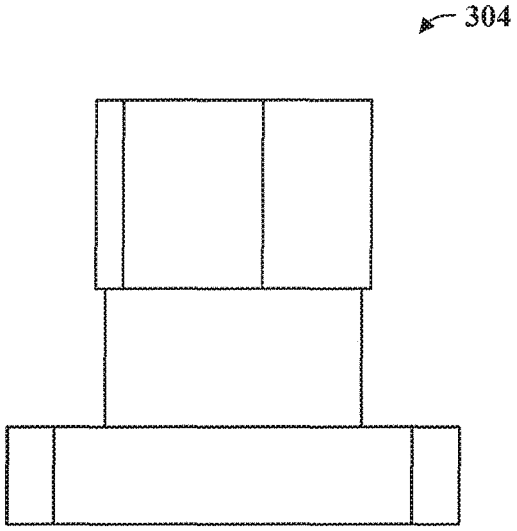
FIG. 18 is a side view of the second version of a mounting fastener illustrated in FIG. 4.
Figure 19:
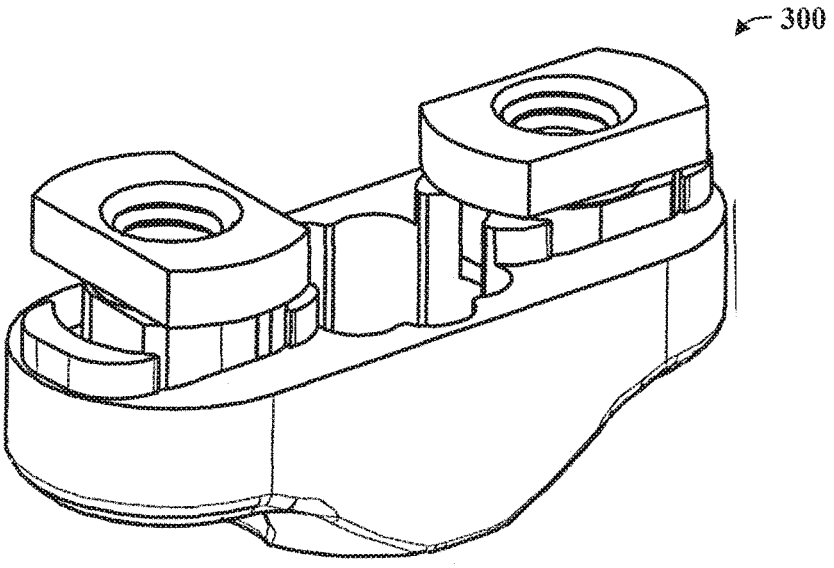
FIG. 19 is a perspective view of a firearm accessory in the form of a sling mount including the fourth version of a mounting fastener illustrated in FIG. 6.
Figure 20:
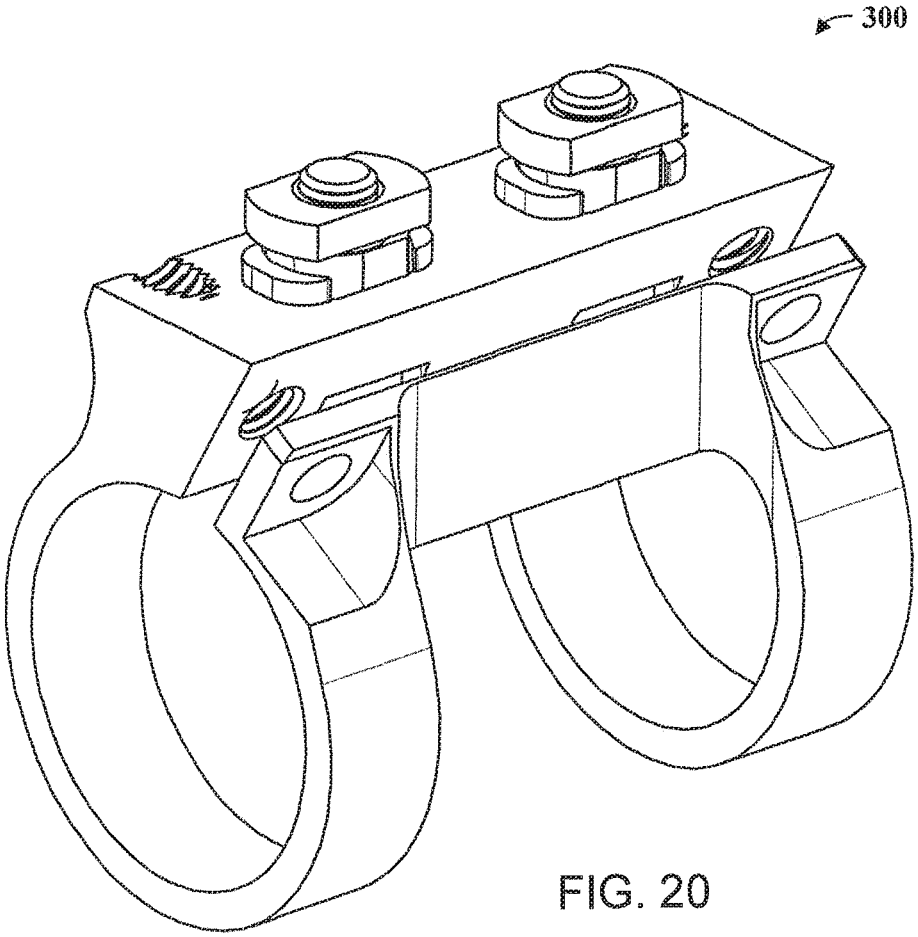
FIG. 20 is a perspective view of a firearm accessory in the form of a pistol grip including the second version of a mounting fastener illustrated in FIG. 4.
Figure 21:
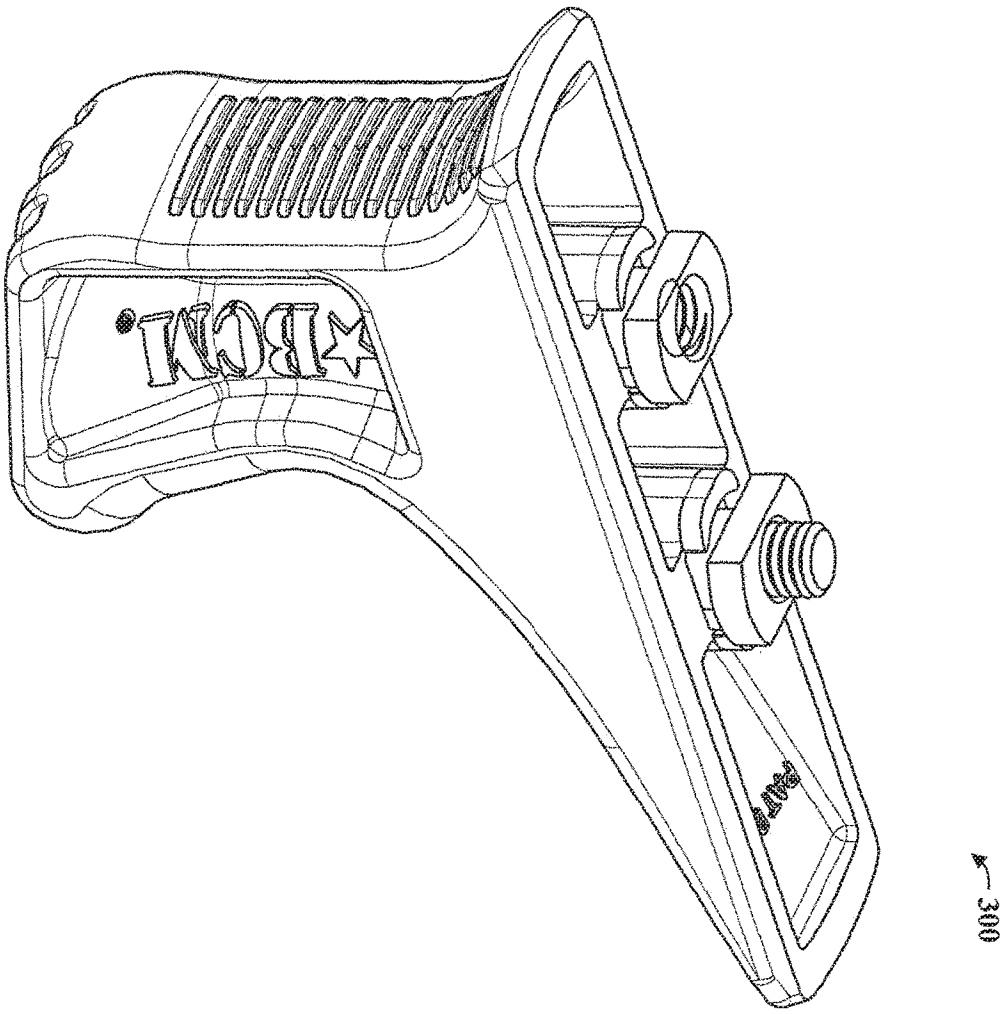
FIG. 21 is a perspective view of a firearm accessory in the form of a sling mount including the fourth version of a mounting fastener illustrated in FIG. 6.
Figure 22:
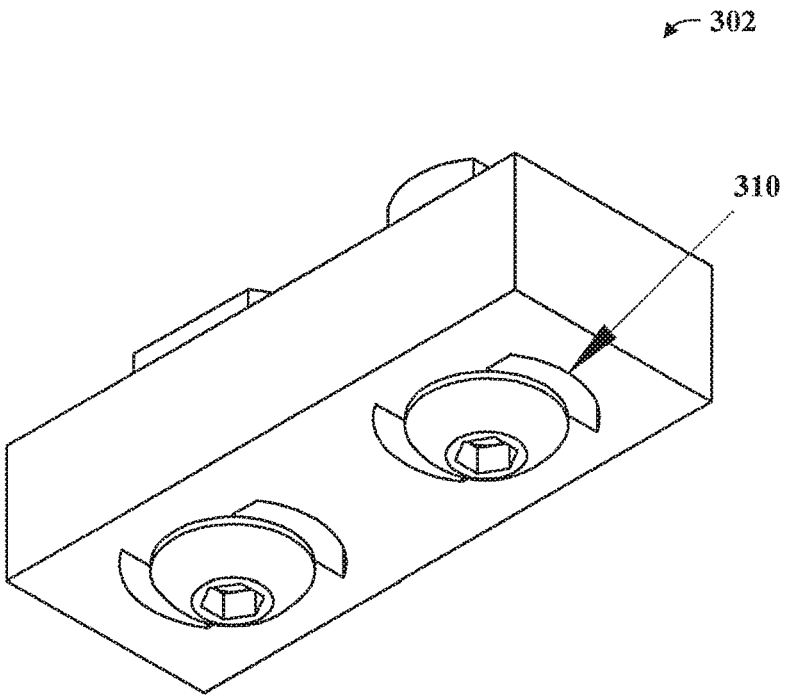
FIG. 22 is a perspective view of a firearm accessory mounting system including the third version of a mounting fastener illustrated in FIG. 5.
Figure 23:
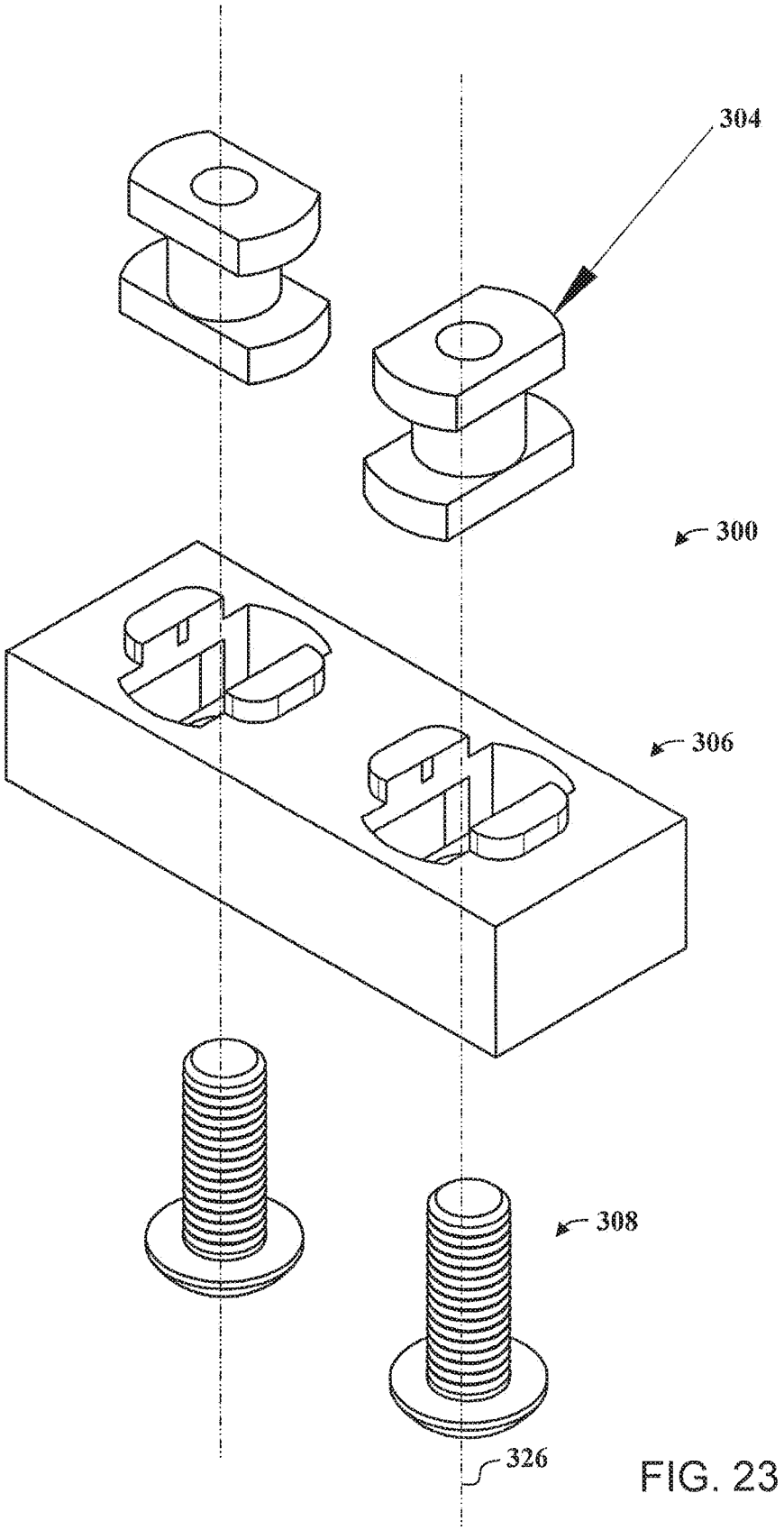
FIG. 23 is an exploded perspective view of the firearm accessory mounting system shown in FIG. 22.
Figure 28:
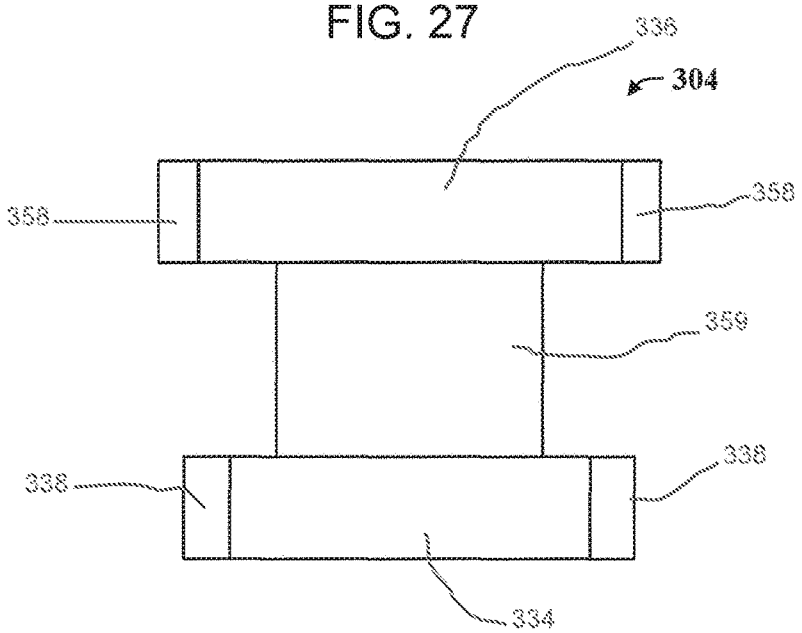
FIG. 28 is a side view of the third version of a mounting fastener illustrated in FIG. 5.

Referring to FIGS. 17-18, in one embodiment, the mounting fastener 304 is not required to contact the inner surface of the rail to secure the accessory to the firearm and strictly uses the accessory interface slot to allow a 90 degree rotation. Referring to FIGS. 27-28, in one embodiment, the mounting fastener 304 does not include a diamond shape.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

Many modifications and variations of the present invention are possible in light of the above teachings, all of which are within the scope of concepts disclosed and claimed in this specification. In addition, the reference numerals in the claims are merely for convenience and are not to be read in any way as limiting.

What is claimed is:

1. A firearm accessory mounting system for coupling a firearm accessory to a firearm, comprising:

a mounting assembly coupled to a firearm accessory;

a mounting fastener extending outwardly from the mounting assembly and configured to rotate relative to the mounting assembly between a locked position and an unlocked position, the mounting fastener including a locking assembly configured to contact a firearm handguard to facilitate coupling the firearm accessory to the firearm handguard, and a positioning assembly positioned within a cavity defined within the mounting assembly; and a mounting bolt rotatably coupled to the mounting fastener for rotating the mounting fastener between the locked position and the unlocked position, wherein the positioning assembly includes a contact surface configured to engage a sidewall of the cavity when the mounting fastener is in the locked position, wherein the mounting fastener is rotatable from the unlocked position toward the locked position in a locking direction, wherein the mounting fastener is rotatable from the locked position toward the unlocked position in an unlocking direction opposite the locking direction, and wherein the engagement between the contact surface and the sidewall inhibits rotation of the mounting fastener in the locking direction beyond the locked position.

2. The firearm accessory mounting system of claim 1, wherein the mounting fastener includes a cylindrical relief section spanning between the locking assembly and the positioning assembly.

3. The firearm accessory mounting system of claim 2, wherein the mounting fastener defines a barbell shape.

4. The firearm accessory mounting system of claim 1, wherein the locking assembly is configured to align with an elongated slot on the firearm handguard when the mounting fastener is in the unlocked position such that the locking assembly can pass through the slot, and wherein the locking assembly is configured to extend across the elongated slot when the mounting fastener is in the locked position to prevent the locking assembly from passing through the slot.

5. A firearm accessory mounting system for coupling a firearm accessory to a firearm, comprising:

a mounting fastener extending outwardly from the firearm accessory, the mounting fastener including a locking assembly and a positioning assembly; and a mounting bolt rotatably coupled to the mounting fastener, wherein the mounting fastener is rotatable between an unlocked position, in which the locking assembly is insertable through an elongated slot in the firearm handguard, and a locked position, in which the locking assembly is prevented from passing through the elongated slot, in response to rotation of the mounting bolt, wherein the mounting fastener is rotatable from the unlocked position toward the locked position in a locking direction, wherein the mounting fastener is rotatable from the locked position toward the unlocked position in an unlocking direction opposite the locking direction, and wherein the positioning assembly is engageable with the firearm accessory to inhibit further rotation of the mounting fastener in the locking direction when the mounting fastener is in the locked position.

6. The firearm accessory mounting system of claim 5, wherein the positioning assembly is engageable with the firearm accessory to inhibit further rotation of the mounting fastener in the unlocking direction when the mounting fastener is in the unlocked position.

7. The firearm accessory mounting system of claim 5, wherein the locked position is offset from the unlocked position by 90 degrees.

8. The firearm accessory mounting system of claim 5, wherein the mounting fastener includes a cylindrical relief section spanning between the locking assembly and the positioning assembly.

9. The firearm accessory mounting system of claim 8, wherein the mounting fastener defines a barbell shape.

10. A firearm accessory mounting system for coupling a firearm accessory to a firearm, comprising:

a mounting fastener extending outwardly from the firearm accessory, the mounting fastener including a locking assembly and a positioning assembly; and a mounting bolt rotatably coupled to the mounting fastener, wherein the mounting fastener is rotatable between an unlocked position, in which the locking assembly is insertable through an elongated slot in the firearm handguard, and a locked position, in which the locking assembly is prevented from passing through the elongated slot, in response to rotation of the mounting bolt, wherein the mounting fastener is rotatable from the unlocked position toward the locked position in a locking direction, wherein the positioning assembly is engageable with the firearm accessory to inhibit further rotation of the mounting fastener in the locking direction when the mounting fastener is in the locked position, wherein the mounting fastener includes a cylindrical relief section spanning between the locking assembly and the positioning assembly, and wherein the mounting fastener defines a barbell shape.

* * * * *